US008272851B2

(12) United States Patent
Lucas

(10) Patent No.: US 8,272,851 B2
(45) Date of Patent: Sep. 25, 2012

(54) FLUIDIC ENERGY TRANSFER DEVICES

(75) Inventor: Timothy S. Lucas, Ashland, VA (US)

(73) Assignee: Influent Corporation, Providence Forge, VA (US)

( * ) Notice: Subject to any disclaimer, the term of this patent is extended or adjusted under 35 U.S.C. 154(b) by 918 days.

(21) Appl. No.: 12/224,783

(22) PCT Filed: Mar. 7, 2007

(86) PCT No.: PCT/US2007/005713
§ 371 (c)(1),
(2), (4) Date: Jan. 22, 2009

(87) PCT Pub. No.: WO2007/103384
PCT Pub. Date: Sep. 13, 2007

(65) Prior Publication Data

US 2009/0148320 A1 Jun. 11, 2009

Related U.S. Application Data

(60) Provisional application No. 60/780,037, filed on Mar. 7, 2006.

(51) Int. Cl.
*F04B 17/00* (2006.01)

(52) U.S. Cl. ..... 417/413.1; 239/102.1

(58) Field of Classification Search ..... 417/413.1, 417/413.2, 53, 481; 239/102.1, 102.2
See application file for complete search history.

(56) References Cited

U.S. PATENT DOCUMENTS

| | | | | |
|---|---|---|---|---|
| 4,231,287 | A | 11/1980 | Smiley | |
| 5,002,471 | A * | 3/1991 | Perlov | 417/413.1 |
| 5,319,938 | A | 6/1994 | Lucas | |
| 5,515,684 | A | 5/1996 | Lucas et al. | |
| 5,579,399 | A | 11/1996 | Lucas | |
| 5,632,841 | A | 5/1997 | Hellbaum et al. | |
| 6,230,420 | B1 | 5/2001 | Lawrenson et al. | |
| 6,388,417 | B1 | 5/2002 | Keith | |
| 6,514,047 | B2 | 2/2003 | Burr et al. | |
| 6,734,603 | B2 | 5/2004 | Hellbaum et al. | |
| 2004/0021398 | A1 | 2/2004 | East | |
| 2005/0089415 | A1 * | 4/2005 | Cho et al. | 417/413.2 |
| 2006/0011737 | A1 * | 1/2006 | Amenos et al. | 239/102.1 |

FOREIGN PATENT DOCUMENTS

| | | | |
|---|---|---|---|
| JP | 10-252657 | A | 9/1998 |
| WO | WO 2006088514 | A2 * | 8/2006 |

OTHER PUBLICATIONS

Chinese Office Action received in Chinese Application No. 200780016071.9 dated May 24, 2010.
International Search Report for International Application No. PCT/US2007/005713 mailed Aug. 12, 2008, 2 pgs.
Written Opinion of the International Search Authority for PCT/US2007/005713 mailed Aug. 12, 2008, 3 pgs.

* cited by examiner

*Primary Examiner* — Mariceli Santiago
*Assistant Examiner* — Glenn Zimmerman
(74) *Attorney, Agent, or Firm* — Foley & Lardner LLP

(57) ABSTRACT

A fluid energy transfer device, including a chamber for receiving a fluid, at least a portion of the chamber comprising a movable portion relative to another portion of the chamber, the movable portion being adapted to change the volume of the chamber from a first volume to a second volume by movement of the movable portion. The device further includes an actuator attached to the movable portion, wherein the displacements of the movable portion can be larger than the displacement of the actuator.

12 Claims, 16 Drawing Sheets

FLUIDIC ENERGY TRANSFER DEVICES

CROSS-REFERENCE TO RELATED PATENT APPLICATIONS

This application claims priority to U.S. Provisional Patent Application No. 60/780,037, filed on Mar. 7, 2006, by Timothy S. Lucas of Providence Forge, Va., U.S.A., entitled "Fluidic Energy Transfer Devices," the contents of which is incorporated herein by reference in their entirety.

The PCT Patent Application PCT/US2005/046557, filed Dec. 22, 2005, entitled Reaction-Drive Energy Transfer Device, by Timothy S. Lucas, is hereby referenced, the contents of which are incorporated herein by reference in their entirety.

BACKGROUND OF THE INVENTION

1) Field of Invention

This invention relates generally to apparatus and methods for conveying energy into a volume of fluid and more specifically to the field of linear pumps, linear compressors, synthetic jets, resonant acoustic systems and other fluidic devices.

2) Description of Related Art

For the purpose of conveying energy to fluids within a defined enclosure, prior technologies have employed a number of approaches, including positive displacement, agitation such as with mechanical stirring or the application of traveling or standing acoustic waves, the application of centrifugal forces and the addition of thermal energy. The transfer of mechanical energy to fluids by means of these various methods can be for a variety of applications, which could include for example, compressing, pumping, mixing, atomization, synthetic jets, fluid metering, sampling, air sampling for biowarfare agents, ink jets, filtration, driving physical changes due to chemical reactions, or other material changes in suspended particulates such as comminution or agglomeration, or a combination of any of these processes, to name a few.

Within the category of positive displacement machines, diaphragms have found widespread use. The absence of frictional energy losses makes diaphragms especially useful in downsizing positive displacement machines while trying to maintain high energy efficiency. The interest in MESO and MEMS scale devices has lead to even further reliance on diaphragm type and diaphragm/piston (i.e. a piston with a flexible surround) type devices for conveying energy into fluids within small pumps or other fluidic devices. The term "pump" as used herein refers to devices designed for providing compression and/or flow for either liquids or gases. The term "fluid" used herein is understood to include both the liquid and the gaseous states of matter.

The actuators used to drive larger diaphragm pumps have proved problematic for MESO or MEMS machines since it is difficult to maintain their efficiency and low cost as they are scaled down in size. For example, the air gaps associated with electromagnetic and voice coil type actuators must be scaled down in order to maintain high transduction efficiency and this adds manufacturing complexity and cost. Also, motor laminations become magnetically saturated as motors are scaled down while seeking to maintain a constant mechanical power output. Within acceptable product cost targets, it is widely accepted that the electro-mechanical efficiency of these transducers will drop off significantly with size reduction.

These scaling challenges, associated with conventional magnetic actuators, have led to the widespread use of other technologies, such as electrostrictive actuators (e.g. piezoceramics), piezoceramic benders, electro-static and magnetostrictive actuators for MESO and MEMS applications. A piezo bender disk can naturally combine the fluid diaphragm and actuator into a single component.

The advantages of using the piezo as the fluidic diaphragm are offset by the piezo's inherent displacement limitations. Since ceramics are relatively brittle, piezoceramic diaphragms/disks can only provide a small fraction of the displacements provided by other materials such as metals, plastics, and elastomers, for example. The peak oscillatory displacements that a clamped circular piezoceramic disk can provide without failure are typically less than 1% of the disk's clamped diameter. Since diaphragm displacement is directly related to the fluidic energy transferred per stroke, piezo benders impose a significant limitation on the power density and overall performance of small fluidic devices such as MESO-sized pumps and compressors. These displacement-related energy limitations are especially true for gases.

Other types of piezo actuators that depend on the bulk flexing properties of the piezo material can provide high energy transfer to liquids by operating at very high frequencies, but at even smaller strokes. These small actuator strokes make the design of pumps impractical. Further, high-performance pumps employ passive valves that open and close each pumping cycle to provide optimal pumping efficiency. These pump valves may not provide the needed performance in the kHz-MHz frequency range that bulk-piezo actuators need to transfer sufficient energy.

Currently, the demand is increasing for ever smaller fluidic devices which may not be attainable or functionally consistently useful with current piezo pump technology. For example, pumps and compressors are needed that can provide higher power densities and specific flow rates (i.e. fluid volume flow rate divided by the pump's physical volume) at higher pressure heads and in ever smaller sized units. Examples of applications that require high performance MESO-sized pumps include the miniaturization of fuel cells for portable electronic devices such as portable computing devices, PDAs and cell phones; self-contained thermal management systems that can fit on a circuit card and provide cooling for microprocessors and other semi-conductor electronics and portable personal medical devices for ambulatory patients. Thus, there is a need for a compact economically viable piezo pump that remedies at least some of the deficiencies of current piezo pumps.

SUMMARY OF THE INVENTION

To satisfy these needs and overcome the limitations of previous efforts, the present invention is provided as a fluid energy-transfer device that uses new floating reaction-drive actuators for driving diaphragm and piston fluidic devices, such as pumps, compressors, synthetic jets and acoustic devices at a drive frequency and sometimes at or near their system resonance. To further satisfy these needs and overcome the limitations of previous efforts, the present invention is provided as a fluid energy-transfer device that enables the use of low-stroke high-force actuators for driving large diaphragm and piston strokes for fluidic devices, such as pumps, compressors and synthetic jets at a drive frequency and sometimes at or near their system resonance.

A fluidic energy transfer device according to one embodiment comprises a fluid chamber having an inner wall shaped so as to form a chamber volume with an opening and a fluidic diaphragm being rigidly attached to the perimeter of the opening and with a variable reluctance actuator being attachment to the fluidic diaphragm. The reaction-drive energy-transfer device according to some embodiments of the present invention provides a unique system for driving displacements of the fluidic diaphragm which can be an order of magnitude larger than the displacement of prior piezo diaphragms.

The reaction-drive system according to most embodiments of the present invention enables high-performance for devices such as MESO-sized pumps, compressors, synthetic jets and acoustic devices. The pumps and compressors according to some embodiments of the present invention may include tuned ports and valves that allow low-pressure fluid to enter and high-pressure fluid to exit a compression chamber in response to the cyclic compressions. The reaction-drive system may use a variety of actuators, such as bender actuator comprising uni-morph, bi-morph and multilayer PZT benders, piezo-polymer composites such as PVDF, crystalline materials, magnetostrictive materials, electroactive polymer transducers (EPTs), electrostrictive polymers and various "smart materials" such as shape memory alloys (SMA), radial field PZT diaphragm (RFD) actuators, as well as variable reluctance actuators and voice coil actuators.

The fluidic devices according to the present invention can be operated at a drive frequency that allows energy to be stored in the system's mechanical resonance, thereby providing diaphragm or piston displacements that can be larger and typically much larger that the actuator's displacements. The system resonance may be determined based on the effective moving mass of the diaphragm, actuator and related components and on the spring stiffness of the fluid, the fluidic diaphragm, and other optional mechanical springs; and or other components/environments that influence the resonant frequency.

The pumps according to some embodiments of the present invention may be utilized in a variety of applications including by way of example only the general compression of gases such as air, hydrocarbons, process gases, high-purity gases, hazardous and corrosive gases, with the compression of phase-change refrigerants for refrigeration, air-conditioning and heat pumps with liquids, and other specialty vapor-compression or phase-change heat transfer applications. The pumps according to some embodiments of the present invention may also pump liquids such as fuels, water, oils, lubricants, coolants, solvents, hydraulic fluid, toxic or reactive chemicals, depending on the particular pump design. The pumps of the present invention can also provide variable capacity for either gas or liquid operation.

More specifically, an exemplary embodiment of the present invention includes a fluid chamber having an inner wall shaped so as to form a chamber volume and having an opening. A fluidic diaphragm or piston is rigidly attached to the perimeter of the opening in the fluid chamber and the diaphragm or piston has a flexible portion capable of moving with respect to the outer perimeter between a plurality of first positions and a plurality of second positions, the first and second positions being of varying distances from the inner wall of the fluidic chamber. The chamber is filled with a fluid that comprises part of the load of the system. The fluid within the fluid chamber comprises a spring and the fluidic diaphragm also comprises a spring. An actuator having an attachment point is attached to the fluidic diaphragm. A mass-spring mechanical resonance frequency is determined by the combined effective moving masses of the actuator and diaphragm or piston and by the mechanical spring and the gas spring, and the actuator is operable over a range of drive frequencies with some frequencies resulting in energy being stored in the mass-spring mechanical resonance and providing displacements of the fluidic diaphragm or piston that are larger (and in many instances much larger) than the displacements of the actuator, such that increased energy is transferred to the fluidic load within the fluid chamber.

In another embodiment of the invention, there is a fluid energy transfer device comprising:

a chamber for receiving a fluid, at least a portion of the chamber comprising a movable portion relative to another portion of the chamber, the movable portion being adapted to change the volume of the chamber from a first volume to a second volume by movement of the movable portion; and a variable reluctance actuator attached to the movable portion;

wherein the variable reluctance actuator is at least one of (i) connected directly to the movable portion and (ii) linked to the movable portion, to form a actuator-movable portion assembly;

wherein the variable reluctance actuator is effectively not connected and effectively not linked to any other component of the device other than the movable portion; and wherein the actuator-movable portion assembly is adapted to move substantially only due to oscillation of the actuator at a drive frequency.

In another embodiment of the present invention, there is a fluid transfer device as described above and/or below, wherein the actuator is driven at a frequency so as to store energy in the system resonance such that the displacements of the movable portion increase proportionately with the stored energy.

In another embodiment of the present invention, there is a fluid transfer device as described above and/or below, wherein the actuator is resiliently connected to a component of the device that is separate from the movable portion.

In another embodiment of the present invention, there is a fluid transfer device as described above and/or below, wherein an air gap of the variable reluctance actuator is adapted to oscillate at a displacement amplitude and frequency such that the actuator and moving portion will move between a first position and a second position substantially only due to the displacement of the actuator, and wherein the distance between the first position and the second position is greater than the displacement amplitude of the actuator air gap.

In another embodiment of the present invention, there is a fluid transfer device as described above and/or below, wherein the movable portion comprises a diaphragm.

In another embodiment of the present invention, there is a fluid transfer device as described above and/or below, wherein the movable portion comprises a piston with a flexible surround.

In another embodiment of the present invention, there is a fluid transfer device as described above and/or below, wherein the device further comprises;

a fluid inlet port in fluid communication with the chamber; and a fluid outlet port in fluid communication with the chamber;

wherein the device is adapted to draw fluid into the chamber through the inlet port during movement of the movable portion in a manner that increases the volume of the chamber, and wherein the device is adapted to expel fluid out of the chamber through the outlet port during movement of the movable portion in a manner that decreases the volume of the chamber.

In another embodiment of the present invention, there is a fluid transfer device as described above and/or below, wherein an opening in the chamber is provided that allows fluid to enter and exit the chamber, and wherein the oscillating flow through said opening creates a synthetic jet.

In another embodiment of the present invention, there is a fluid transfer device as described above and/or below, wherein the chamber movable portion comprises a bellows.

In another embodiment of the invention, there is a fluid energy transfer device comprising:

a chamber for receiving a fluid, at least a portion of the chamber comprising a movable portion relative to another portion of the chamber, the movable portion being is adapted to change the volume of the chamber from a first volume to a second volume by movement of the movable portion; and an electro-active actuator attached to the movable portion;

wherein the electro-active actuator is at least one of (i) connected directly to the movable portion and (ii) linked to the movable portion, to form a actuator-movable portion assembly;

wherein the electro-active actuator is effectively not connected and effectively not linked to any other component of the device other than the movable portion; and wherein the actuator-movable portion assembly is adapted to move substantially only due to oscillation of the actuator at a drive frequency.

In another embodiment of the present invention, there is a fluid transfer device as described above and/or below, wherein a reaction mass is attached to the electro-active actuator In another embodiment of the present invention, there is a fluid transfer device comprising:

a chamber for receiving a fluid, at least a portion of the chamber comprising a flexible portion being movable relative to another portion of the chamber such that a maximum deflection point on the flexible portion provides larger displacements than any other points on the flexible portion, the flexible portion being adapted to change the volume of the chamber from a first volume to a second volume by bending of the flexible portion; and a force generating actuator being attached to the flexible portion at a point other than the maximum deflection point;

wherein the force generating actuator is at least one of (i) connected directly to the flexible portion and (ii) linked to the flexible portion, to form a actuator-movable portion assembly;

wherein the force generating actuator is effectively not connected and effectively not linked to any other component of the device other than the flexible portion; and wherein the actuator-movable portion assembly is adapted to move substantially only due to oscillation of the actuator at a drive frequency.

In another embodiment of the present invention, there is a fluid transfer device as described above and/or below, wherein the diaphragm further comprises a central piston section that becomes the maximum deflection point.

In another embodiment of the present invention, there is a fluid transfer device as described above and/or below, wherein the flexible portion comprises a bellows having at least one bellows section.

In another embodiment of the present invention, there is a fluid transfer device as described above and/or below, wherein the bellows further comprises a central piston section that becomes the maximum deflection point.

In another embodiment of the present invention, there is a fluid transfer device as described above and/or below, wherein said force generating actuator comprises a bender actuator.

In another embodiment of the present invention, there is a fluid transfer device as described above and/or below, wherein said force generating actuator comprises a variable reluctance actuator.

In another embodiment of the present invention, there is a fluid transfer device as described above and/or below, wherein said force generating actuator comprises a solid electro-active actuator.

In another embodiment of the present invention, there is a fluid transfer device comprising:

a chamber for receiving a fluid, at least a portion of the chamber comprising a flexible portion being movable relative to a second portion of the chamber, the flexible portion being adapted to change the volume of the chamber from a first volume to a second volume by bending of the flexible portion; and a pivot clamp that clamps the flexible portion around a closed loop of the flexible portion thereby dividing the flexible portion into 2 sections comprising an inner section within the closed loop and an outer section outside of the closed loop, with the pivot clamp allowing the outer section and inner section to pivot about the pivot clamp such that the displacements of the inner and outer sections are in opposite directions, and at least a single force-generating actuator having an attachment point to the outer section of the flexible portion;

wherein the force generating actuator is at least one of (i) connected directly to the outer section of the flexible portion and (ii) linked to the outer section of the flexible portion, to form a actuator-movable portion assembly;

wherein the force generating actuator is effectively not connected and effectively not linked to any other component of the device other than the outer section of the flexible portion; and wherein the actuator-movable portion assembly is adapted to move substantially only due to oscillation of the actuator at a drive frequency.

In another embodiment of the present invention, there is a fluid transfer device comprising:

a chamber for receiving a fluid, at least a portion of the chamber comprising a first flexible portion being movable relative to a second portion of the chamber such that a maximum deflection point on the first flexible portion provides larger displacements than any other points on the first flexible portion, the first flexible portion being adapted to change the volume of the chamber from a first volume to a second volume by bending of the first flexible portion; and at least a single force-generating actuator having an attachment point to the flexible portion at a point other than the maximum deflection point and an attachment point to the second portion of the chamber;

wherein the force-generating actuator exerts alternating forces between the flexible portion of the chamber and the second portion of the chamber with corresponding changes in the chamber volume; and wherein the resulting peak displacement of the maximum deflection point is greater than the displacement of the force generating actuator.

In another embodiment of the present invention, there is a fluid transfer device as described above and/or below, wherein:

the second portion of the chamber comprises a second flexible portion of the chamber movable relative to the first flexible portion of the chamber, such that a maximum deflection point on the second flexible portion provides larger displacements than any other points on the second flexible portion, and the force-generating actuator also having an attachment point to the second flexible portion at a point other than its maximum deflection point, wherein the force-generating actuator exerts alternating forces between the first and second flexible portions of the chamber thereby resulting in peak displacements, between the maximum deflection points of the first and second flexible chamber portions, that are greater than the displacement of the force generating actuator.

In another embodiment of the present invention, there is a fluid transfer device as described above and/or below, wherein first flexible portion comprising a first piston with a flexible surround, and the second flexible portion comprising a second piston with a flexible surround.

In another embodiment of the present invention, there is a fluid transfer device comprising:

a chamber for receiving a fluid, at least a portion of the chamber comprising a first flexible portion being movable relative to a second portion of the chamber, the first flexible portion being adapted to change the volume of the chamber from a first volume to a second volume by bending of the first flexible portion; and at least a single force-generating actuator having an attachment point to the first flexible portion at a point of zero flexing displacement and an attachment point to the second portion of the chamber and generating forces in the direction of the first flexible portion's flexing displacement;

wherein the force-generating actuator exerts alternating forces between the flexible portion of the chamber and the second portion of the chamber with changes in the chamber volume resulting from the instantaneous sum of the actuator displacement and the flexing displacement of the first flexible portion.

In another embodiment of the present invention, there is a fluid transfer device as described above and/or below, wherein a fluid inlet port in fluid communication with the chamber; and a fluid outlet port in fluid communication with the chamber;

wherein the device is adapted to draw fluid into the chamber through the inlet port during movement of the flexible portion in a manner that increases the volume of the chamber, and wherein the device is adapted to expel fluid out of the chamber through the outlet port during movement of the flexible portion in a manner that decreases the volume of the chamber.

In another embodiment of the present invention, there is a fluid transfer device as described above and/or below, wherein:

the second portion of the chamber comprises a second flexible portion of the chamber movable relative to the first flexible portion of the chamber, and the force-generating actuator also having an attachment point to the second flexible portion at a point of zero flexing displacement of the second flexible portion, wherein the force-generating actuator exerts alternating forces between the first and second flexible portions of the chamber thereby resulting in peak displacements, between the maximum deflection points of the first and second flexible chamber portions, that are greater than the axial displacements of the force generating actuator.

In another embodiment of the present invention, there is a fluid transfer device comprising:

a chamber for receiving a fluid, at least a portion of the chamber comprising a first flexible portion being movable relative to a second portion of the chamber, the first flexible portion being adapted to change the volume of the chamber from a first volume to a second volume by bending of the first flexible portion; and at least a single force-generating actuator having an attachment point to the first flexible portion at a point of zero flexing displacement and generating forces in a direction transverse to first flexible portion's flexing displacement;

wherein the force-generating actuator exerts alternating transverse forces on the first flexible portion of the chamber and with resulting changes in the chamber volume resulting from axial vibrations of the first flexible portion.

In another embodiment of the present invention, there is a fluid transfer device as described above and/or below, wherein:

the second portion of the chamber comprises a second flexible portion of the chamber movable relative to the first flexible portion of the chamber; and the force-generating actuator also having an attachment point to the second flexible portion at a point of zero flexing displacement of the second flexible portion and generating forces in a direction transverse to the second flexible portion's flexing displacement;

wherein the force-generating actuator exerts alternating transverse forces on the first and second flexible portions of the chamber thereby resulting in with resulting changes in the chamber volume resulting from axial vibrations of the first and second flexible portions.

In another embodiment of the present invention, there is a fluid transfer device comprising:

a chamber for receiving a fluid, at least a portion of the chamber comprising a first flexible portion being movable relative to a second portion of the chamber, the first flexible portion being adapted to change the volume of the chamber from a first volume to a second volume by bending of the first flexible portion; and a force-generating actuator having an attachment point to the center of first flexible portion and generating forces in a direction transverse to first flexible portion's axial flexing displacement;

wherein the force-generating actuator exerts alternating transverse forces on the first flexible portion of the chamber with resulting changes in the chamber volume resulting from axial vibrations of the first flexible portion.

In another embodiment of the present invention, there is a fluid transfer device comprising:

a chamber for receiving a fluid, at least a portion of the chamber comprising a flexible portion being movable relative to a second portion of the chamber, the flexible portion being adapted to change the volume of the chamber from a first volume to a second volume by bending of the flexible portion; and a pivot clamp that clamps the flexible portion around a closed loop of the flexible portion thereby dividing the flexible portion into 2 sections comprising an inner section within the closed loop and an outer section outside of the closed loop, with the pivot clamp allowing the outer section and inner section to pivot about the pivot clamp such that the displacements of the inner and outer sections are in opposite directions, and at least a single force-generating actuator having an attachment point to the outer section of the flexible portion and an attachment point to the pivot clamp and generating forces in the same direction as the flexible portion's flexing displacement;

wherein the force-generating actuator exerts alternating forces between the pivot clamp and the outer section of flexible portion with changes in the chamber volume resulting from the flexing of the flexible portion.

In another embodiment of the present invention, there is a fluid transfer device as described above and/or below for transferring energy to acoustic resonators.

In another embodiment of the present invention, there is a fluid transfer device as described above and/or below, wherein the acoustic resonator comprises a resonant synthetic jet.

In another embodiment of the present invention, there is a fluid transfer device as described above and/or below, wherein the acoustic resonator comprises the resonator of an acoustic compressor.

BRIEF DESCRIPTION OF THE DRAWINGS

The accompanying drawings, which are incorporated in and form a part of the specification, illustrate the embodiments of the present invention and, together with the description, serve to explain the principles of the inventions. In the drawings.

DETAILED DESCRIPTION OF SOME EMBODIMENTS

In this section, descriptions of the embodiments of the present invention are organized under subheadings that describe the forces being applied to the diaphragms or pistons of the present invention. The force designations generally indicate the direction of the force with respect to the diaphragm/piston axis (i.e. axial or radial) and the point of application (e.g. on-center/axis, off-center, or at the clamp point).

Reaction-Drive Topologies

PCT patent application PCT/US2005/046557 describes reaction-drive devices with floating bender actuators (such as piezoceramics or any number of other electro-active actuators) the contents of which are incorporated herein by reference in their entirety. The floating-actuator dynamics of reaction-drive systems enables the use of high-force low-stroke actuators, thereby eliminating the expensive electric motors which drive conventional pumps and compressors. The present invention provides further actuators that can be used in reaction-drive systems. For the reaction-drive embodiments the forces are axially directed. The reaction-drive actuators are grouped into two different classes based on where their forces are applied to the fluidic system: (i) axial or piston driven and (ii) off-axis driven.

On-Axis and/or Piston Driving

The actuators discussed under this heading are used for either driving a diaphragm at its center or driving a piston.

Figure 1:
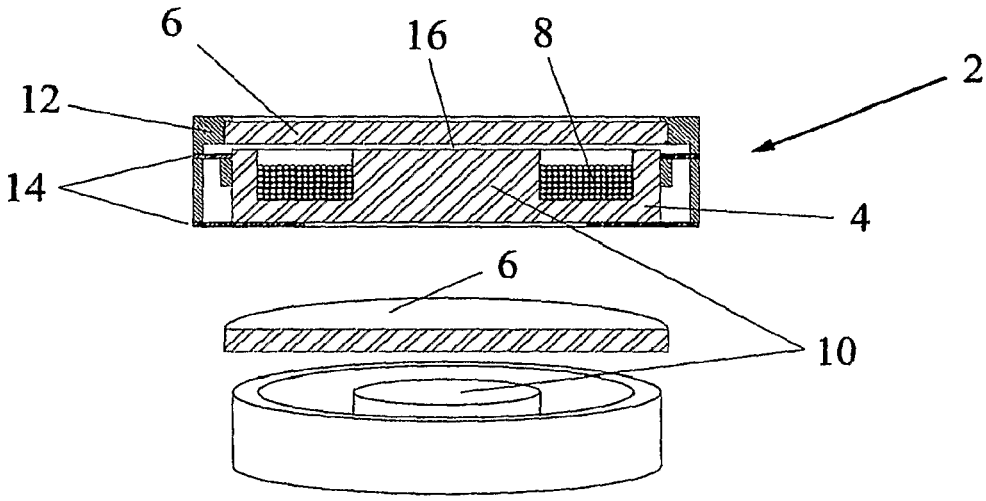
FIG. 1 is a cross sectional view of an embodiment of a variable reluctance (VR) actuator used in the current invention.

Referring now to FIG. 1, there is illustrated a cross-sectional view of one actuator embodiment of the reaction-drive system of the present invention. FIG. 1 illustrates an axisymmetric variable-reluctance (VR) actuator 2, having a coil-wound section 4 and disk section 6. Wire winding 8 is wrapped around center post 10 and coil-wound section 4 is attached to disk section 4 by linkage 12 and springs 14 such as to provide air gap 16. When coil 8 is energized with a DC current the resulting attractive magnetic force causes disk section 6 and coil-wound section 4 to be attracted to each other, thereby reducing air gap 16. When the current goes to zero, springs 14 restore disk section 6 and coil-wound section 4 to their original positions. If an alternating current of frequency f is applied to coil 8, then two attractive forces are created with one being constant in time and the other oscillatory. The oscillating force cause disk section 6 and coil-wound section 4 to be cyclically attracted to each other with a resulting vibrational frequency of 2f; commonly referred to as a parametric response. The constant force results in a reduction of the average air gap while the components are oscillating.

Figure 2:
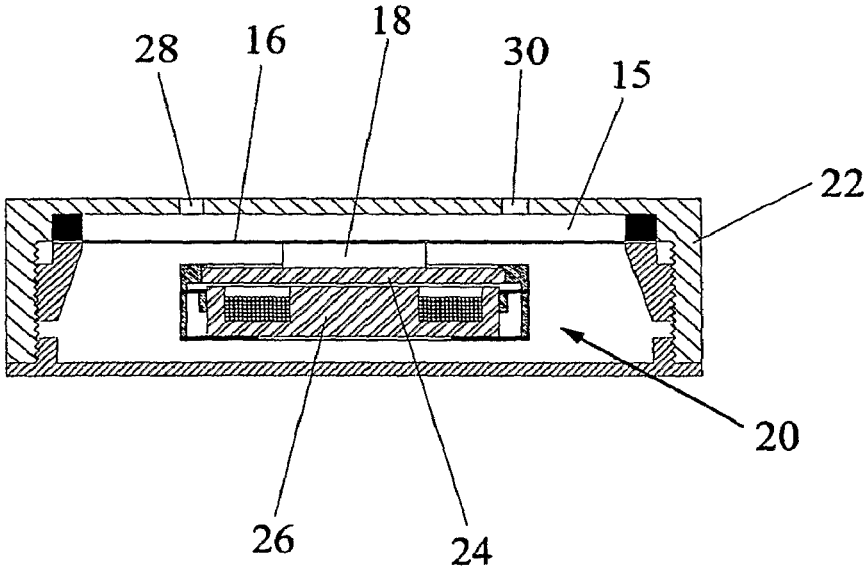
FIG. 2 is a cross-sectional view of an embodiment of the present invention having a VR actuator driving a reaction drive fluidic energy transfer device.

FIG. 2 shows the VR motor 20 of FIG. 1 serving as an actuator for a reaction-drive diaphragm system. Motor 20 is rigidly connected to the center of diaphragm 16 by standoff 18 and fluid chamber 15 is bounded by enclosure 22 and diaphragm 16. Vibration of diaphragm 16 transfers energy to a fluid with fluid chamber 15. Fluid ports 28 and 30 are provided to allow fluid into and out of fluid chamber 15 as would be the case for a pump. However, ports 28 and 30 of FIG. 2 are not meant to indicate a specific fluidic system such as a pump, compressor or synthetic jet, but rather are intended to describe a generic fluidic system being driven by a specific drive system embodiment for transferring energy to the fluid. This same graphic approach is used throughout and is intended to place the emphasis on the drive system which could be used for any number of different fluid applications such as pump, compressors, synthetic jets, resonant acoustic systems, etc.

In operation, an alternating voltage waveform of frequency f is applied to the coil of motor 20 creating a time varying force at frequency 2f which causes motor elements 24 and 26 to vibrate 180° out of phase with each other. The mass of component 24 will typically be smaller than the mass of component 26, thus causing the amplitude of component 24 to be larger than that of component 26. The motion of component 24 is directly transferred to diaphragm 16 via standoff 18, which in turn transfers energy to the fluid within fluid chamber 15. The reaction-drive fluidic system of FIG. 2 will have a mechanical system resonance frequency $f_o=(\frac{1}{2}\pi)(K/M)^{1/2}$ where K=the combined stiffness of diaphragm 16 and spring stiffness of the fluid in fluidic chamber 15, M=roughly the combined effective moving mass of diaphragm 16 and motor 20 and standoff 12 and $f_o$ refers to the system resonance frequency that results with the clamped fluidic diaphragm 6 oscillating in its lowest ordered axial mode shape. For a precise prediction of $f_o$ the motion of enclosure 22 must also be taken into account. Lumped element mechanical and electrical analogue numerical models and other models may be used to predict and/or estimate the fundamental resonance frequency of the fluidic system of FIG. 2.

If a drive frequency f is chosen to be near or equal to the ½ the system's fundamental resonant frequency $f_o$, then energy may be stored in the resonance in proportion to both the system's resonance quality factor Q and the proximity of the drive frequency f to the resonance frequency $f_o$. As energy is stored in the system's resonance, the displacement of diaphragm 16 can exceed the actual air gap oscillation of motor 20. In this way, a low-displacement VR motor may be used to provide the higher diaphragm displacements required by current MESO and MEMS fluidics applications. Since the only substantial (or otherwise effective) mechanical connection to motor 20 of FIG. 2 is to standoff 18, motor 20 is free to ride along with, or float with, the larger displacements of diaphragm 16, even when the oscillating amplitudes of the air gap remain only a fraction of the flexing amplitude of diaphragm 16.

Drive frequencies that result in stored energy and drive frequencies that do not result in stored energy are both considered within the scope of the present invention regardless of the particular embodiment.

The magnetic force generated by a VR motor can be approximated by $F_{mag}=Li/2G$, where L is the motor's inductance, i is the current and G is the air gap distance. Motor losses vary with i and the force generated for a given current will vary with the inverse of the air gap distance G. Consequently, the motor's efficiency will also vary inversely with G. As explained above, in a reaction-drive system the air gap need not oscillate at the same amplitude as the fluid diaphragm. Consequently, small air-gaps can be used which enables high transduction efficiencies in small VR motors. The combination of Reaction-Drive and variable reluctance actuators eliminates the need for high-cost conventional miniature electric motors. In FIG. 1, disk section 6 and coil-wound section 4 can be made from Soft Magnetic Composites (SMCs) like the Hoganas materials, which have low losses at higher frequencies, such as above 100 Hz. These materials are inexpensive and can be formed into shapes like that of motor 2 in FIG. 1.

While motor 2 of FIG. 1 provides excellent coil utilization, other topologies which are not axi-symmetric such EI, EIE IEEI and CI magnetic sections can also be used and can be constructed from transformer steel laminations or SMC materials as is well known in the art. Any actuator that benefits from small air-gaps can also be used. U.S. Pat. No. 6,388,417 discloses many different VR actuator topologies and related drive and control systems which can be used within the scope of the present invention, the contents of which are incorporated herein by reference in their entirety.

Figure 3:
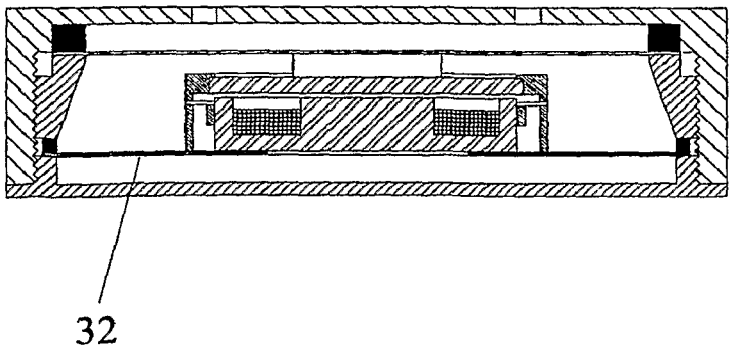
FIG. 3 is a cross-sectional view of an embodiment of FIG. 2 further comprising a stabilizing spring.

Many enhancements can be made to the reaction-drive device shown in FIG. 2, as disclosed in PCT Application No. PCT/US2005/046557, such as stabilizing spring 32 as shown in FIG. 3. Further applications of such embodiments and enhancements as found in the referenced PCT application will be obvious to one skilled in the art. For embodiments that are similar to the embodiment of FIG. 3, stabilizing spring 32 can be used as the principal spring stiffness of the system, thus allowing the spring stiffness of a diaphragm or piston to be much softer if so desired for a given application. Referring to FIG. 2, other attachment points for stabilizing or secondary springs could include motor component 24 or stand-off 18.

Figure 4:
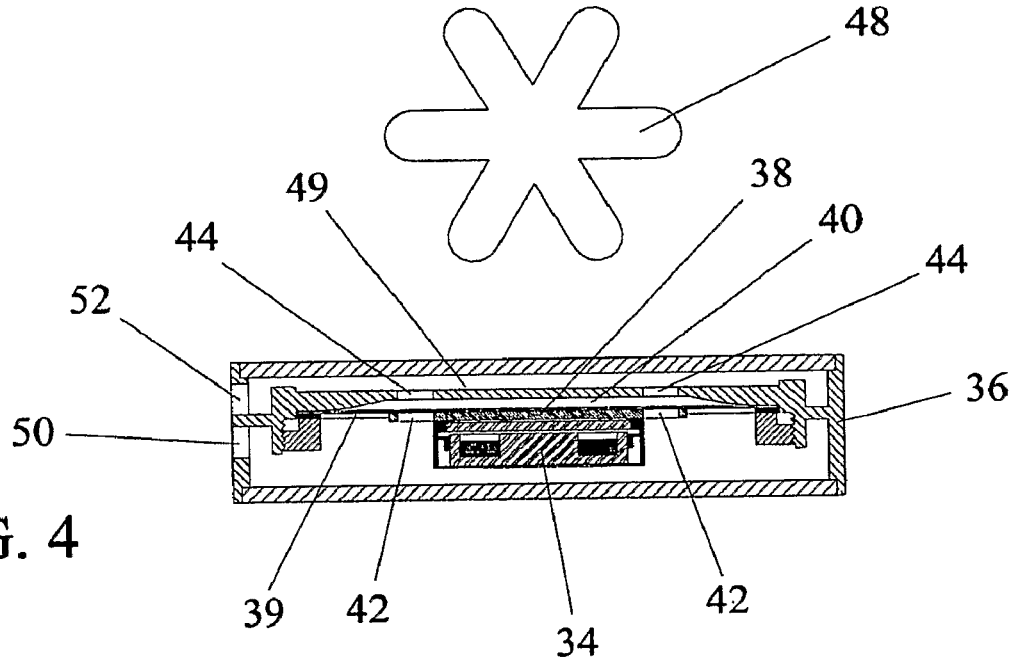
FIG. 4 is a cross-sectional view of an embodiment of the present invention having a VR actuator driving a piston within a reaction-drive fluidic pump.

FIG. 4 shows how a VR motor can be applied in a reaction-drive system to drive a piston pump or compressor. Within pump body 36, motor 34 is rigidly connected to piston 38 having a flexible surround 39 attached thereto and with flexible surround 39 being clamped around its perimeter, thereby allowing piston 38 to vibrate axially. Unless stated otherwise, the term piston as used herein means a piston with a flexible surround similar to piston 38 of FIG. 4. Flexible surrounds can be constructed from metal, plastics, elastomers or any materials that fit the structural, stress and chemical compatibility requirements of a given application. Fluid chamber 40 is bounded by piston 38 and pump body 36. Inlet ports 42 are located in piston 38 and outlet ports 44 are located in pump body 36. Two reed valves, having a topology like that of reed valve 48, are provided to cover the inlet and outlet ports. The inlet reed valve lies on the upper face of piston 38 and the outlet reed valve lies on surface 49 of pump body 36. Both inlet and outlet reed valves are fastened at their centers with the reed tips free to open and close in response to the oscillating fluid pressures within fluid chamber 40. In operation, motor 34 drives the oscillating piston displacements resulting in fluid compression and flow, whereby fluid enters pump body 36 through port 50 and exits through port 52. Operating the pump at or near its system resonant frequency will result in piston displacements becoming larger in proportion to the energy stored in the system. Diaphragm embodiments as shown in FIG. 2 can also benefit from the tapered compression chamber shown in FIG. 4. For compressor applications, tapered compression chambers will reduce the clearance volume thereby increasing the compression ratio for a given stroke amplitude. In FIG. 3 the top of the compression chamber would be shaped to match the bending shape of diaphragm.

Figure 5:
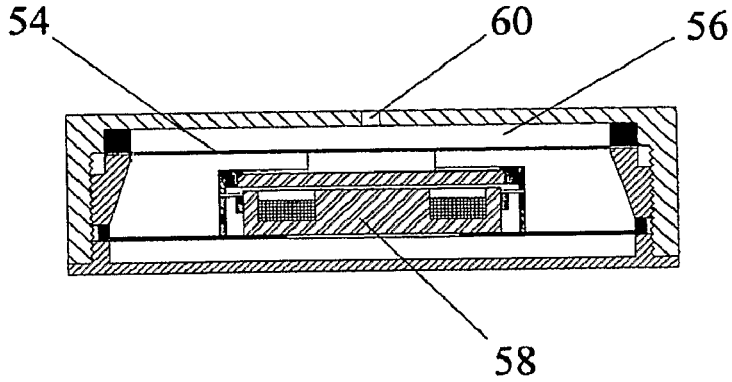
FIG. 5 is a cross-sectional view of an embodiment of the present invention having a VR actuator driving a diaphragm for creating a synthetic jet.

FIG. 5 illustrates how a VR motor can be used to drive a synthetic jet. In operation, motor 58 oscillates diaphragm 54 such that the fluid within fluid chamber 56 experiences cyclic pressure variations, thereby creating an oscillating fluid flow through port 60 and a resulting pulsating flow outside of port 60 that travels axially away from port 60. Operating the device at or near its system resonant frequency will result in diaphragm displacement becoming larger in proportion to the energy stored in the system. Any of the fluidic drive systems of the present invention could be used in combination with synthetic jets. For example, drive embodiments using pistons, diaphragms, electro-active bender actuators, VR motors, bulk flexing of electro-active materials, or any of the embodiments of the present invention including the embodiments shown in PCT Application No. PCT/US2005/046557 could be used to drive synthetic jets. The advantage provided by the present invention with respect to synthetic jets is the ability to drive significantly larger oscillating air/gas flow through the port in a given size device, resulting in larger jet flow rates.

Figure 6:
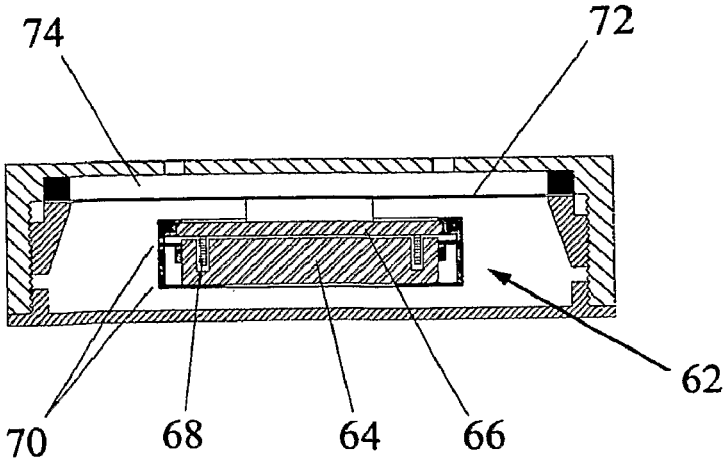
FIG. 6 is a cross-sectional view of an embodiment of the present invention having a voice-coil actuator driving a reaction-drive fluidic energy transfer device.

FIG. 6 shows a voice-coil actuator 62 driving a reaction-drive fluidic system. Voice-coil actuator 62 comprises a permanent magnet section 64 connected by springs 70 to a voice coil section 66 having a voice coil 68 rigidly connected thereto. When voice coil 68 is energized with an alternating current, then motor sections 66 and 64 will vibrate 180° out of phase with each other. Operating the device at or near its system resonant frequency will result in diaphragm displacements becoming larger in proportion to the energy stored in the system. As energy is stored in the system's resonance, the displacement of diaphragm 16 can exceed the relative displacements between voice coil section 66 and magnet section 64. As such, motor 62 is free to ride along with, or float with, the larger displacements of diaphragm 72. The resulting oscillations of diaphragm 72 transfer energy to the fluid within fluid chamber 74.

Figure 7:
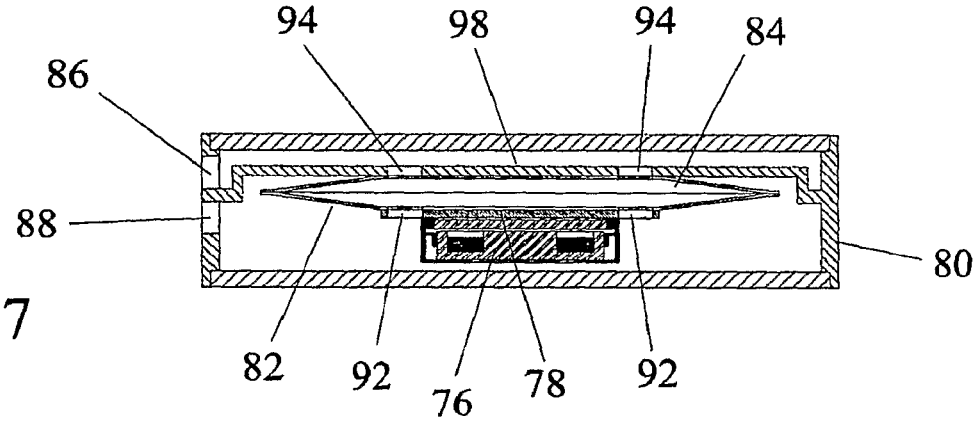
FIG. 7 is a cross-sectional view of an embodiment of the present invention having a VR actuator driving a bellows compression chamber within a reaction drive pump or compressor.

FIG. 7 provides another reaction-drive embodiment having a pump body 80 which houses a VR-motor 76 being rigidly attached to piston 78 with piston 78 being rigidly attached to the single section of bellows 82. Bellows 82 is in turn rigidly attached to pump body 80. Bellows 82 could have 2, 3 or any number of sections depending on the design requirements of a specific application. Compression chamber 84 is bounded by pump body 80, bellows 82 and piston 78. Bellows 82 acts as part of the pump's effective mechanical spring stiffness in determining the pump's system resonance frequency. The pump of FIG. 7 will have inlet and outlet reed valves similar to reed valve 48 of FIG. 4 with an inlet reed valve being installed on the top surface of piston 78 to cover inlet ports 90 and an outlet reed valve being installed on surface 98 of pump body 80, thereby covering outlet ports 94. The additional petals of the reed valve will cover ports not shown in the cutaway plane of FIG. 7.

In operation, motor 76 drives bellows 82 resulting in a volume oscillation of compression chamber 84 and consequent fluid compression and flow, whereby fluid enters pump body 80 through port 88 and exits through port 86. Operating the device at or near its system resonant frequency will result in piston displacements becoming larger in proportion to the energy stored in the system. Although the pump in FIG. 7 uses a single bellows section, any number of bellows sections could be used. The number of bellows sections used will be determined by the requirements of a particular application. Any of the other actuators disclosed herein can be used to drive the embodiment of FIG. 7, such as electro-active bender actuators, solid electro-active actuators, and various VR actuator topologies, as well as any other force-generating actuator.

Figure 8:
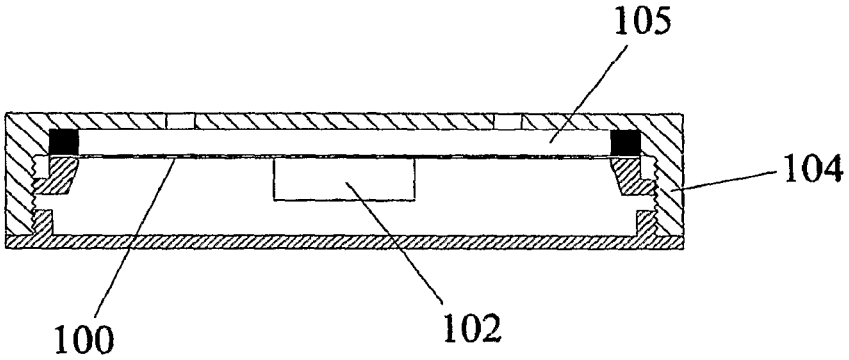
FIG. 8 is a cross-sectional view of an embodiment of the present invention having a solid electro-active actuator driving a reaction-drive fluidic energy transfer device.

FIG. 8 illustrates yet another simple high-force low-stroke actuator that can be used in combination with the reaction-drive system where a cylindrically-shaped electro-active actuator 102 which is rigidly connected to diaphragm 100. Electro-active actuator 102 can be constructed from any number of electro-active materials including piezoceramics, piezo-polymer composites such as PVDF, crystalline materials, magnetostrictive materials, electroactive polymer transducers (EPTs), electrostrictive polymers and various "smart materials" such as shape memory alloys (SMA) actuators made from materials such as Nitinol or magnetostrictive materials such as Terfenol-D. Any material that changes its shape in response to the cyclic application of energy could almost certainly be used as actuator 102 in FIG. 8 or in any other embodiments of the present invention.

In order to explain the operation of actuator 102, it is assumed that actuator 102 is made from a piezoceramic material. The orientation of actuator 102 is such that the application of an electric field of given polarity will cause the Z dimension of actuator 102 to contract. Upon reversing the field polarity, the Z dimension of actuator 102 will expand. When an electric field having a polarity that oscillates at frequency f is applied, then the actuator's Z dimension will oscillate at frequency f. It is intended that the electro-active actuator type will be chosen so that the principle vibrations of actuator 102 will be axial.

In operation, the Z axis vibrations of actuator 102 will cause diaphragm 100 to vibrate thereby transferring energy to the fluid within fluid chamber 105. In order to increase the diaphragm displacements and fluid energy transfer, an oscillating electric field is applied to actuator 102 having a frequency that is close enough to the system resonance frequency such that energy is stored in the system resonance resulting in diaphragm displacements that are proportional to the stored energy. The closer the drive frequency is to the instantaneous system resonance frequency, the greater the stored energy and the greater the fluid energy transfer. Drive frequencies that result in stored energy and drive frequencies that do not result in stored energy are both within the scope of the present invention regardless of the particular embodiment.

Figure 9:
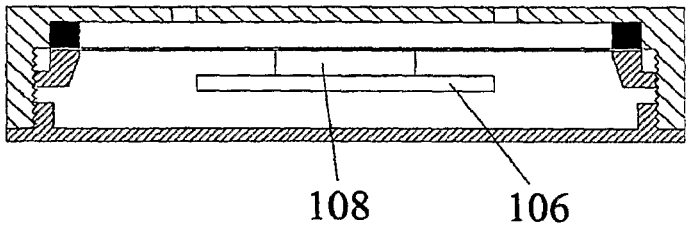
FIG. 9 is a cross-sectional view of an embodiment of the present invention having a solid electro-active actuator with a reaction mass driving a reaction-drive fluidic energy transfer device.

In FIG. 9 is shown an enhancement to the reaction-drive system of FIG. 8 wherein a reaction mass 106 is rigidly attached to actuator 108. Actuator 108 operates in the same manner as actuator 102 of FIG. 8. As described in PCT Patent Application No. PCT/US2005/046557, the reaction mass can increase magnitude and efficiency of energy transferred from the actuator to the diaphragm and consequently to the fluid.

Figure 10:
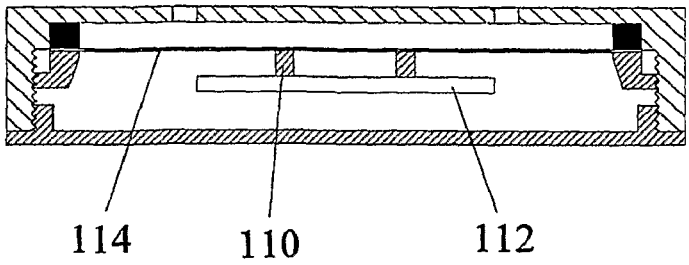
FIG. 10 is a cross-sectional view of an embodiment of the present invention having an annular cylindrical shaped solid electro-active actuator with a reaction mass driving a reaction-drive fluidic pump.

FIG. 10 illustrates the use of another actuator in a reaction-drive system. Actuator 110 has an annular cylindrical shape. The bottom of an actuator 110 is attached to reaction mass 112 and the top of actuator 110 is attached to diaphragm 114. In operation the reaction-drive system of FIG. 10 is identical to FIGS. 8 and 9.

Many different electro-active actuators could be used within the scope of the embodiments of FIGS. 8-10 as long as they flex in the Z dimension. The shapes and materials chosen will reflect the requirements of a given application. For example, "composite" or layered piezo actuators that reduce the applied voltage required for a given displacement could be used in the embodiments of FIGS. 8-10.

It is understood for the embodiments of FIGS. 8-10 that the rigidity or stiffness of the actuator-to-diaphragm attachments or actuator-to-piston attachments will reflect the type of actuator being used. For example, while the flexing in the Z dimension transfers energy to the system, most electro-active actuators will typically flex in all dimensions, although not equally. Referring to FIG. 8, when actuator 102 flexes in the Z direction it will also flex in X and Y. If the actuator-diaphragm attachment is rigid, then flexing in all directions will be constrained and the energy transferred for a given applied voltage amplitude will be reduced. For this reason a point-type connection will generally be preferable as opposed to the surface connections shown in FIGS. 8-10. For example, point connections which lie on the cylindrical axis of actuator 102 in FIG. 8 would reduce the constraint on 3D flexing and optimize power transfer. Other solutions may include the use of resilient surface connections, but care must be taken that these connections do not absorb energy since they could act as dampers in the system. In general, the polarization and material properties of the electro active actuator should be chosen so as to maximize the actuator's deflection in force-delivering direction and minimize the actuator's deflection in the other directions.

The electro-active actuator embodiments of FIGS. 8-10 are shown as driving diaphragms, but can also drive piston and bellows designs as seen in FIGS. 4 and 7.

Figure 10A:
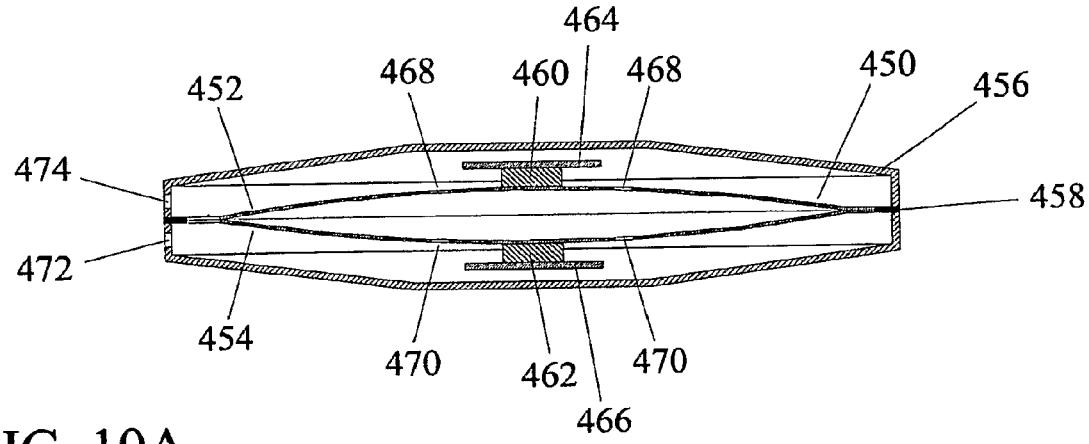
FIG. 10A is a cross-sectional view of an embodiment of the present invention having a bellows compression chamber driven by two solid electro-active actuators in a reaction-drive fluidic pump.

FIG. 10A illustrates another on-axis reaction-drive embodiment having a bellows 450 formed by an upper diaphragm 452 and a lower diaphragm 454 with the bellows 450 being attached around its perimeter to housing 456 via soft annular spring 458. The upper surface of actuator 460 is attached to optional reaction mass 464 and lower surface is attached to the center of upper diaphragm 452. The lower surface of actuator 462 is attached to optional reaction mass 466 and the upper surface is attached to the center of lower diaphragm 454. Upper diaphragm 452 has outlet ports 468 and the lower diaphragm 454 has inlet ports 470. These ports will typically be covered with reed valves which open and close in response to the changing pressure inside of bellows 450 and the reed valve materials used would need to be compliant enough to maintain a seal over the ports despite bending of the diaphragms. With respect to placement of the read valves, the ports in upper diaphragm 452 could serve as either inlet ports or outlet ports and likewise with lower diaphragm 454. It is assumed in FIG. 10A that the inlet reed valve is installed on lower diaphragm 454 and the outlet reed valve is installed on upper diaphragm 452.

For the sake of explanation, it is assumed that actuators 460 and 462 are solid electro-active actuators, such as piezoceramics, although any of the actuators discussed in connection with the present invention could alternatively be used. In operation, actuators 460 and 462 are energized with an alternating electric field of frequency f and the resulting cyclic displacement of actuators 460 and 462 cause the volume of bellows 450 to vary at frequency f. The resulting time varying pressure within bellows 450 will cause fluid to be drawn into port 472 and expelled from port 474. Optional reaction mass 464 and 466 can be used to tune the system's resonant frequency. Operating the pump of FIG. 10A at or near its system resonance frequency will result in a bellows displacement that becomes larger in proportion to the energy stored in the system.

Off Axis Driving

Off-axis driving provides a means to tune the impedance of the load to the impedance of the actuator in a reaction-drive system and can also be used to reduce the acceleration-related stresses on the actuator.

Figure 11:
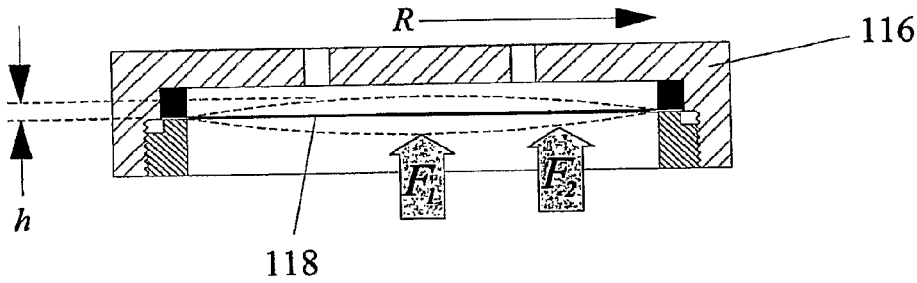
FIG. 11 is a cross-sectional view of an embodiment of the present invention that provides a conceptual illustration of "off-axis driving" of a reaction-drive fluidic energy transfer device.

FIG. 11 illustrates the principles of off-axis driving. The reaction-drive system has a housing 116 and a diaphragm 118 of radius R. In the embodiments discussed above the actuator's force is usually applied to the center of diaphragm 118 as illustrated by the arrow labeled as force $F_1$. Diaphragm 118 is free to bend as an edge-clamped diaphragm and its bending envelope is shown by the dotted lines. In this idealized representation, on-axis driving can be thought of as applying a force $F_1$ at r=0. In the general sense, r=0 is only a special case of a number of different radial locations where the force can be applied to oscillate diaphragm 118. For a more general case, FIG. 11 shows a force $F_2$ being applied at an off-axis point, call it r=x. As the force application point is varied from r=0 to r=R, then the force required to displace the diaphragm's center a given amount h increases but the associated diaphragm displacement at the point of applied force decreases. In other words, for a fixed drive frequency the mechanical impedance of the load increases with r.

Figure 12:
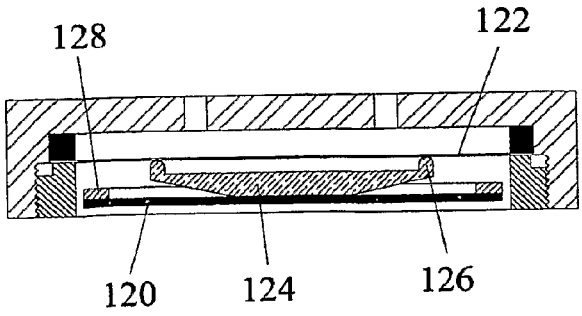
FIG. 12 is a cross-sectional view of an off-axis driven reaction-drive fluidic energy transfer device being driven by a bender actuator having a center power take off (PTO) point.

FIG. 12 illustrates one embodiment of off-axis driving in a reaction-drive system, where bender actuator 120 is connected at its center to the base of standoff 124 and the annular lip 126 of standoff 124 is resiliently connected to diaphragm 122 so as to not restrict the normal bending of diaphragm 122. An annular reaction mass 128 is attached to the perimeter of the bender actuator. The power-take-off of bender actuator 120 is at its center. In operation, the center of diaphragm 122 will experience higher vibrational displacements than the center of bender actuator 120, assuming that standoff 124 is rigid. Operating the device of FIG. 12 at or near its system resonance frequency will result in diaphragm displacements that become larger in proportion to the energy stored in the system.

As is characteristic for Reaction-Drive systems, bender actuator 120 rides along with, or floats with, the displacements of diaphragm 122. Even though the bending displacements of bender actuator 120 can be much smaller than the bending displacements of diaphragm 122, actuator 120 can experience additional stresses related to riding along with the high accelerations of diaphragm 122. The off-axis driving system of FIG. 12 reduces the diaphragm-imposed accelerations of bender actuator 120 by moving its attachment point away from the diaphragm's center which sees the highest accelerations.

Figure 13:
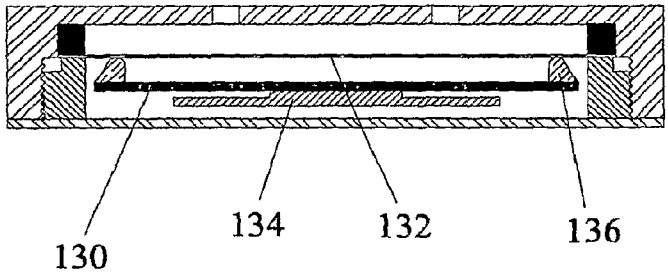
FIG. 13 is a cross-sectional view of an off-axis driven reaction-drive fluidic energy transfer device being driven by a bender actuator having a perimeter PTO point.

FIG. 13 shows an off-axis driving embodiment for Reaction-Drive systems that further reduces the acceleration imposed on bender actuator 130 by diaphragm 132. Bender actuator 130 has a reaction mass connected to its center. The PTO point for bender actuator 130 is around its perimeter via annular stand-off 136. Compared to the off-axis driving system of FIG. 12, the system of FIG. 13 further reduces the acceleration imposed on the bender actuator by the diaphragm, due to the larger diaphragm contacting radius of standoff 136. A further advantage of off-axis driving can be seen by a comparison of FIG. 13 and FIG. 9. When an actuator is attached to the center of the diaphragm as shown in FIG. 9 transverse instabilities can result, where the actuator can experience undesirable transverse motions thereby creating additional stress on the diaphragm and actuator as well as additional noise and vibration of the device. Since the actuator in FIG. 13 is attached close to the clamp point of diaphragm 132 a much greater degree of transverse rejection will be provided when compared to the embodiment of FIG. 9.

Figure 14:
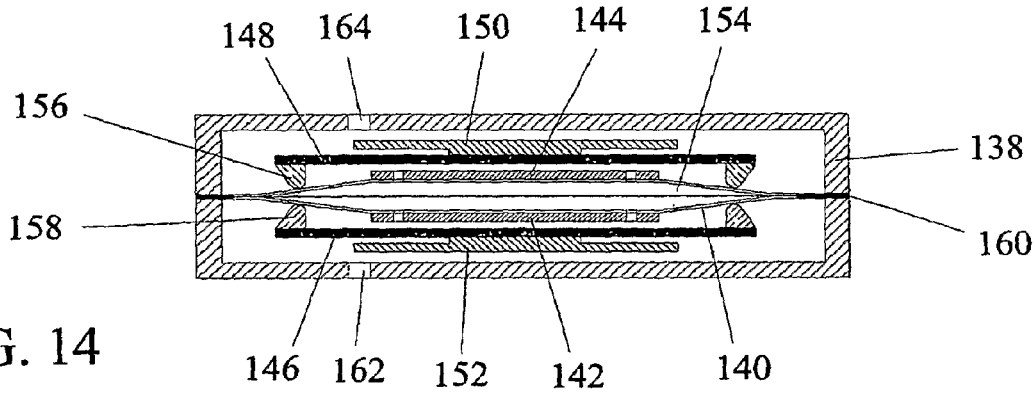
FIG. 14 is a cross-sectional view of an off-axis driven embodiment of the present invention having two bender actuators driving a dual-piston bellows compression chamber within a reaction-drive pump or compressor.

FIG. 14 illustrates another application of off axis driving for Reaction-Drive systems. The pump body 138 houses a dual-piston dual-actuator system. A compression chamber 154 is bounded by bellows 140, piston 142 and piston 144. Bender actuator 148 has a reaction mass 150 attached to its center and an annular stand-off 156 attached to its perimeter, with stand-off 156 being attached in turn to the upper portion of bellows 140. Bender actuator 146 has a reaction mass 152 attached to its center and an annular stand-off 158 attached to its perimeter, with stand-off 158 being attached in turn to the lower portion of bellows 140. The outer perimeter of bellows 140 is an attached to pump housing 138 by soft annular spring 160 and serves to isolate the vibrations of bellows 140 from pump housing 138. Piston 144 and piston 142 each have valved ports. Inlet and outlet read valves, similar to reed valve 48 shown in FIG. 4, can be used in the pump embodiment of FIG. 14. For example, and inlet reed valve could be attached to the upper surface of piston 142 and an outlet reed valve could be attached to the upper surface of piston 144. Flow through vents would be required in stand-off 156 and stand-off 158 in order to allow the flow of fluid into and out of the inlet ports and outlet ports.

In the operation, bender actuators 148 and 146 would be energized so as to apply oscillating and opposing forces to bellows 140, which in turn causes pistons 144 and 142 to vibrate 180° out of phase with each other. If the frequency of the applied force is at or near to the system's resonant frequency, then large piston displacements will result with consequent fluid compression and flow, whereby fluid enters pump body 138 through port 162 and exits through port 164. In the embodiment of FIG. 14, pistons 142 and 144 can be eliminated and replaced by two diaphragms, thereby providing another embodiment of the present invention.

Figure 15:
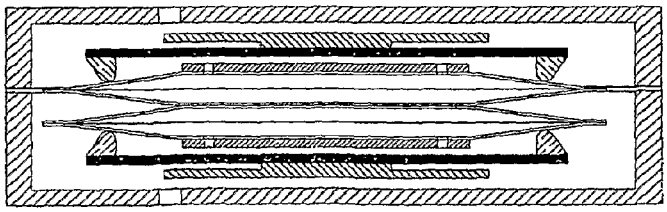
FIG. 15 is a cross-sectional view of an off-axis driven embodiment of the present invention having two bender actuators driving a dual-piston double-bellows compression chamber within a reaction-drive pump or compressor.

FIG. 15 illustrates another application of off-axis driving for Reaction-Drive systems. The embodiment is similar to that of FIG. 14 except for the addition of a second bellows section. Any number of bellows sections can be used in the current invention with the exact number of sections used being a function of a specific application's requirements.

Figure 16:
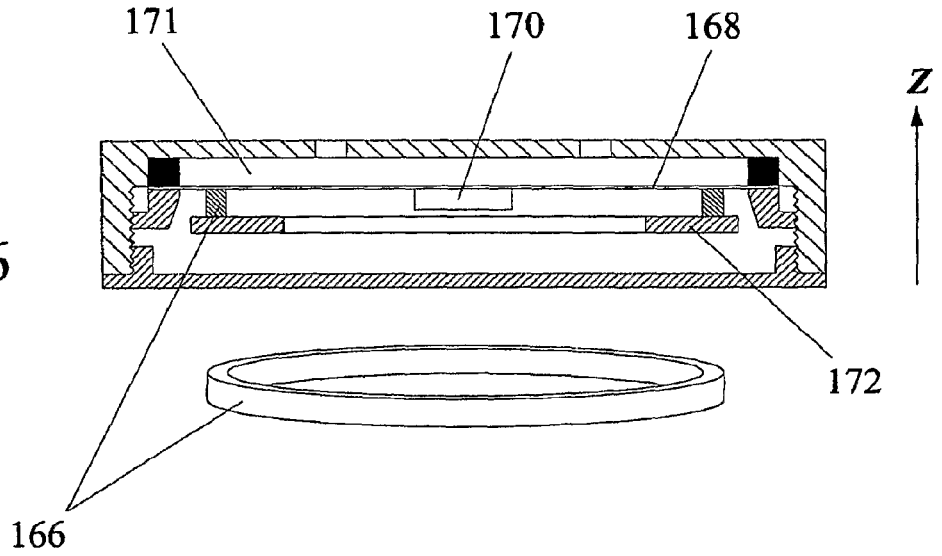
FIG. 16 is a cross-sectional view of an off-axis driven embodiment of the present invention having a solid electro active actuator with a reaction mass within a reaction-drive fluidic energy transfer device.

FIG. 16 illustrates another actuator that can be used for off-axis driving of Reaction-Drive systems. An annular electro-active actuator 166 is provided having it's upper surface attached to diaphragm 168 and its lower surface attached to optional reaction mass 172. An optional tuning mass 170 can be attached to the center of diaphragm 168. In order to explain the operation of actuator 166, it is assumed that actuator 166 is made from a piezoceramic material. The orientation of actuator 166 is such that the application of an electric field of given polarity will cause its Z dimension to contract. Upon reversing the field polarity, the Z dimension of actuator 166 will expand. When an electric field having a polarity that oscillates at frequency f is applied, then the actuator's Z dimension will oscillate at frequency f.

In operation, the Z axis vibrations of actuator 166 will cause diaphragm 168 to vibrate thereby transferring energy to the fluid within fluid chamber 171. In order to increase the diaphragm displacements and fluid energy transfer, an oscillating electric field is applied to actuator 166 having a frequency that is close enough to the system resonance frequency such that energy is stored in the system resonance resulting in diaphragm displacements that are proportional to the stored energy.

Figure 17:
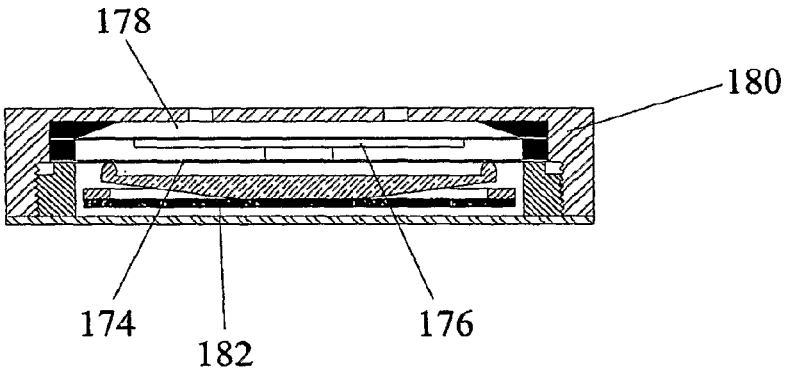
FIG. 17 is a cross-sectional view of an off-axis driven embodiment of the present invention having a bender actuator with a reaction mass and a center PTO point driving a diaphragm which in turn drives a piston within a reaction-drive fluidic energy transfer device.

FIG. 17 shows an off-axis driving system similar to the driving system of FIG. 12 wherein diaphragm 174 drives piston 176 and the fluid chamber 178 is bounded by enclosure 180 and piston 176. The PTO for bender actuator 182 is at its center.

Figure 18:
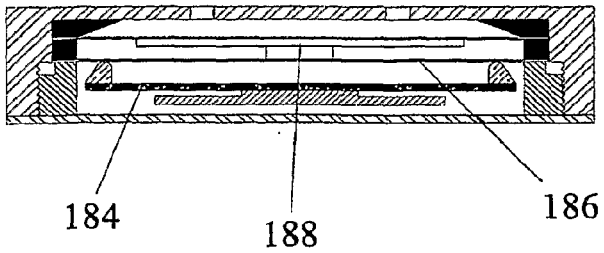
FIG. 18 is a cross-sectional view of an off-axis driven embodiment of the present invention having a bender actuator with a reaction mass and a perimeter PTO point driving a diaphragm which in turn drives a piston within a reaction-drive fluidic energy transfer device.

FIG. 18 shows an off-axis driving system similar to the driving system of FIG. 13 wherein diaphragm 186 drives piston 188 and the PTO point for bender actuator 184 is at its perimeter.

Figure 18A:
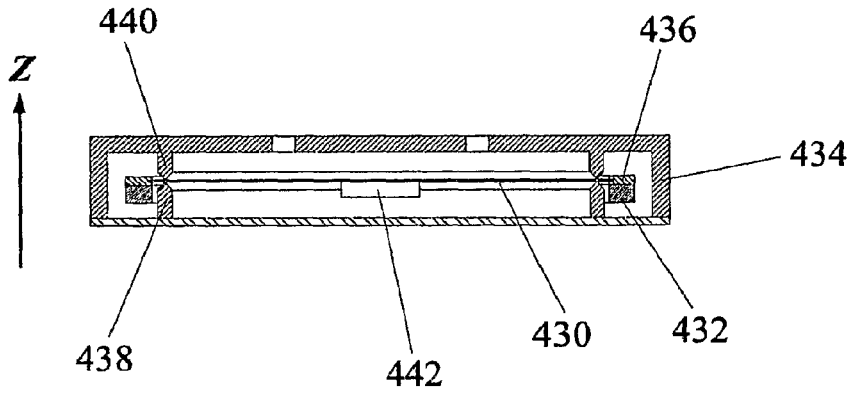
FIG. 18A is a cross-sectional view of an off-axis edge-driven reaction-drive embodiment of the present invention having an annular electro-active actuator, which drives the edge of a diaphragm outside of its clamp circle.

FIG. 18A illustrates an off-axis edge-driven diaphragm embodiment of the present invention, having an enclosure 434, a diaphragm 430, an optional tuning mass 442, an annular electro active actuator 432 and annular knife edge clamps 438 and 440. The top surface of the actuator 432 is attached to the edge, or perimeter, of diaphragm 430 via connector 436. When actuator 432 is energized it creates a force in parallel with the Z axis. If the force is in the −Z direction, then the center of diaphragm 430 will move in the +Z direction. Likewise, if the force is in the +Z direction, then the center of diaphragm 430 will move in the −Z direction.

If diaphragm 430 is excited by actuator 432 at a frequency f that is below the higher ordered resonant modes of diaphragm 430, then the diaphragm will respond by oscillating in its fundamental axial mode shape at frequency f. If diaphragm 430 is driven at a frequency f that is near or equal to the system fundamental resonance frequency, then energy will be stored in the system resonance and the displacements of diaphragm 430 will increase proportionately to the stored energy. The system resonance can be tuned using optional mass 442. Mass 442 and actuator for 432 are always moving in opposite directions, so by choosing the correct masses the forces that they exert on enclosure 434 can be reduced or canceled, thereby reducing enclosure vibrations and associated noise.

Figure 18B:
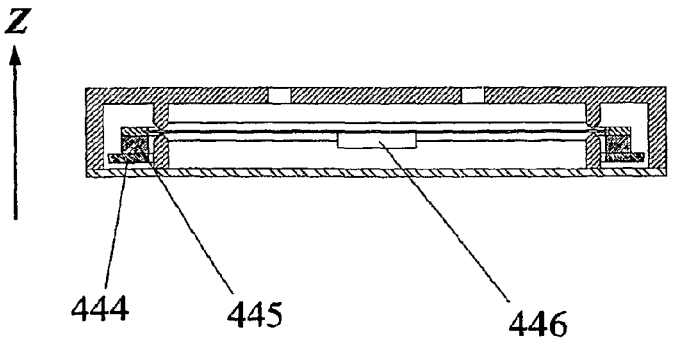
FIG. 18B is a cross-sectional view of an off-axis edge-driven reaction-drive embodiment of the present invention having an annular electro-active actuator with a reaction mass, which drives the edge of a diaphragm outside of its clamp circle.

The embodiment of FIG. 18B, operates in the same manner as the embodiment of FIG. 18A, except for the addition of an annular reaction mass 444 to actuator 445 for improving energy transfer to the fluid. As in the embodiment of FIG. 18A, the masses of tuning mass 446, actuator 445 and reaction mass 444 can be chosen to reduce or cancel enclosure vibrations and associated noise.

Many improvements and modifications can be made to the Reaction-Drive embodiments of the present invention and will be obvious to those who are skilled in the art. For example, unsupported actuator wire leads may experience excessive stresses due to actuator vibration. A solution to this problem is illustrated by referring to FIG. 2. Wire leads from motor 20 could be bonded to stand-off 18 and diaphragm 16, thereby following a fully supported path back to housing 22 which is the mechanical ground. Other actuators could also be used with the present invention such as moving magnet actuators and moving coil actuators.

Mechanically Grounded Actuators

For the following embodiments of the present invention the actuator does not float but instead is mechanically grounded to the housing of the fluidic device.

Off-Axis Driving

Figure 19:
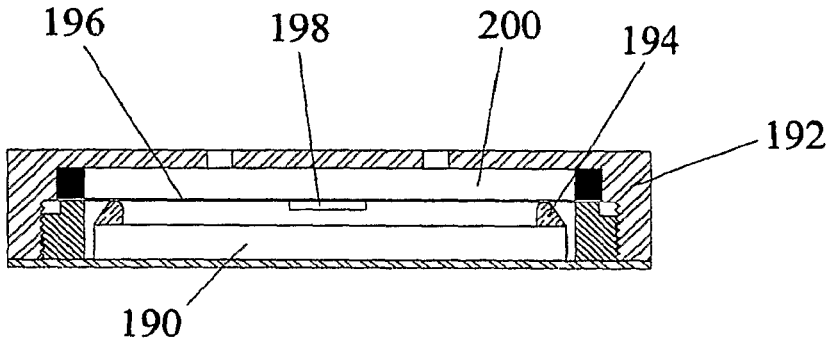
FIG. 19 is a cross-sectional view of an off-axis driven embodiment of the present invention having a generic mechanically grounded actuator which drives a diaphragm within a fluidic energy transfer device.

FIG. 19 illustrates a grounded actuator design where the bottom surface of a generic actuator 190 is attached to housing 192 and its top surface is connected to stand-off 194 which in turn is resiliently connected to diaphragm 196. A tuning mass 198 is connected to the center of diaphragm 196 and can be used to adjust the system resonance frequency. According to the principles of off-axis driving explained previously, a small deflection of actuator 190 will result in a larger deflection at the center of diaphragm 196, due to the mechanical amplification of the system. The resulting amplification factor varies proportionately with the diameter of stand-off 194. Within the scope of the present invention any type of actuators can be used in the fluidic energy delivery system of FIG. 19.

The fluidic energy transfer system of FIG. 19 will also have a mechanical system resonance frequency $f_o=(\frac{1}{2}\pi)(K/M)^{1/2}$ where K=the combined effective stiffness of diaphragm 16 and the springs stiffness of the fluid in fluid chamber 200, M=the combined effective moving mass of diaphragm 196 and tuning mass 198 and $f_o$ refers to the system resonance frequency that results in diaphragm 196 axially oscillating in its lowest ordered mode shape. For a precise prediction of $f_o$ the motion of housing 192 must also be taken into account.

Lumped element mechanical and electrical analogue numerical models and other models may be used to predict and/or estimate the fundamental resonance frequency of the fluidic system of FIG. 19, or of any of the embodiments of the present invention.

In operation, the Z axis vibrations of actuator 190 will cause diaphragm 196 to vibrate thereby transferring energy to the fluid within fluid chamber 200. In order to increase the diaphragm displacements and fluid energy transfer, an oscillating electric field is applied to actuator 190 having a frequency that is close enough to the system resonance frequency such that energy is stored in the system resonance resulting in diaphragm displacements that are proportional to the stored energy. The closer the drive frequency is to the instantaneous system resonance frequency, the greater the stored energy and the greater the fluid energy transfer. Drive frequencies that result in stored energy and drive frequencies that do not result in stored energy are both within the scope of the present invention regardless of the particular embodiment.

Figure 20:
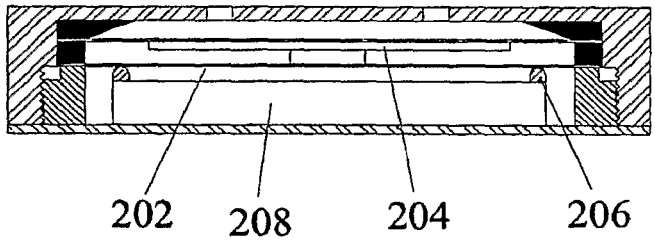
FIG. 20 is a cross-sectional view of an off-axis driven embodiment of the present invention having a generic mechanically grounded actuator which drives a diaphragm which in turn drives a piston within a fluidic energy transfer device.

FIG. 20 utilizes the same drive system as shown in FIG. 19 except that diaphragm 202 is used to drive piston 204. The result is a mechanical amplification whereby the displacement of piston 204 is greater than the displacement of actuator 208. The resulting amplification factor varies proportionately with the diameter of stand-off 206. Piston displacements can be increased by driving the device at a frequency that stores energy in the system resonance.

Figure 21:
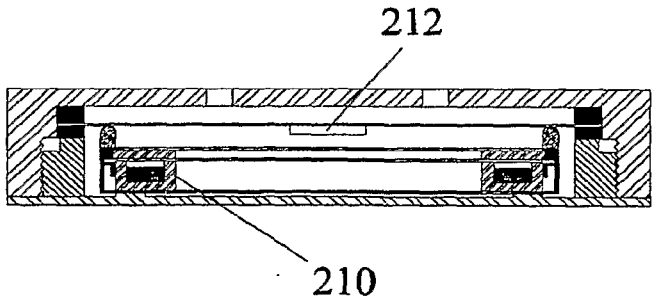
FIG. 21 is a cross-sectional view of an off-axis driven embodiment of the present invention having a VR actuator being mechanically grounded which drives a diaphragm within a fluidic energy transfer device.

FIG. 21 illustrates an off-axis driving system like that of FIG. 19 where the grounded actuator is an annular VR motor. The system's mechanical amplification relieves the VR motor of having to provide large displacements. Consequently, the VR motor can maintain small air gaps and thus high electromechanical efficiencies as previously discussed. Optional reaction mass 212 can be used to tune the system's resonant frequency. The fluidic energy transfer device of FIG. 21 operates in the same manner as the fluidic energy transfer device of FIG. 19.

Figure 22:
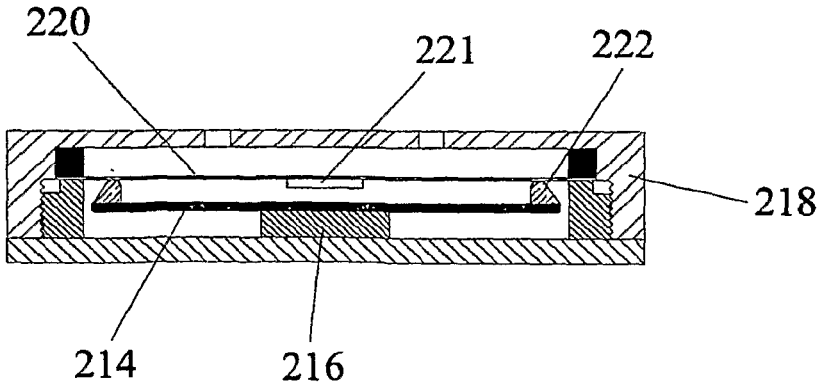
FIG. 22 is a cross-sectional view of an off-axis driven embodiment of the present invention having a bender actuator being mechanically grounded at its center which drives a diaphragm within a fluidic energy transfer device.

FIG. 22 illustrates another off-axis driving system using a grounded bender actuator 214 which is grounded at its center by stud 216 to enclosure 218. The perimeter of bender actuator to 214 is connected to diaphragm 220 by annular stand-off 222. The system's amplification factor allows for the use of very-high force low-displacement bender actuators and the specific amplification factor varies proportionately with the diameter of stand-off 206. The fluidic energy transfer device of FIG. 22 operates in the same manner as the fluidic energy transfer device of FIG. 19. Optional reaction mass 221 can be used to tune the system's resonant frequency.

Figure 23:
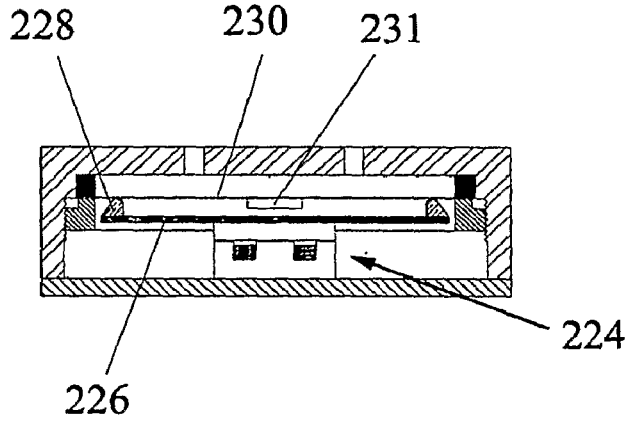
FIG. 23 is a cross-sectional view of an off-axis driven embodiment of the present invention having a mechanically grounded VR actuator which drives a diaphragm within a fluidic energy transfer device.

FIG. 23 illustrates another off-axis driving system using a grounded the VR actuator 224. The forces of the VR actuator are transmitted to the diaphragm 230 by rigid disk 226 and annular stand-off to 228. The fluidic energy transfer device of FIG. 23 operates in the same manner as the fluidic energy transfer device of FIG. 19. Optional reaction mass 231 can be used to tune the system's resonant frequency.

Figure 24:
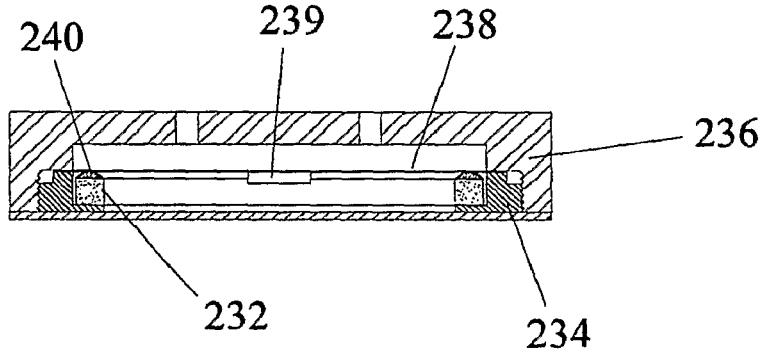
FIG. 24 is a cross-sectional view of an off-axis driven embodiment of the present invention having a mechanically grounded annular electro active actuator which drives a diaphragm within a fluidic energy transfer device.

FIG. 24 illustrates another off-axis driving system using an annular electro-active actuator 232. The base of actuator 232 is grounded to enclosure 236 via clamp ring 234 and the top of actuator 232 is resiliently connected to diaphragm 238 via standoff 240. The fluidic energy transfer device of FIG. 24 operates in the same manner as the fluidic energy transfer device of FIG. 19. Optional reaction mass 239 can be used to tune the system's resonant frequency.

Figure 25:
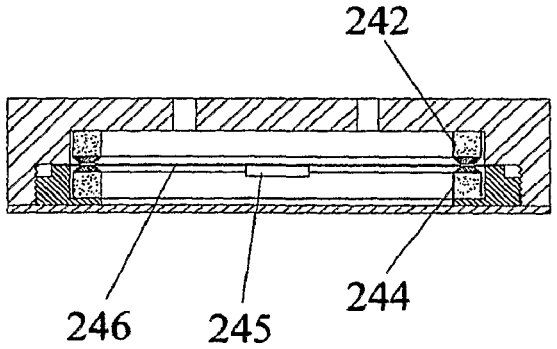
FIG. 25 and is a cross-sectional view of an off-axis driven embodiment of the present invention having a dual mechanically grounded annular electro active actuators which drive a diaphragm within a fluidic energy transfer device.

FIG. 25 illustrates a further off-axis driving system using two opposed annular electro-active actuators 244 and 242 which are energized so as to apply similarly directed forces to diaphragm 246. Otherwise, the fluidic energy transfer device of FIG. 25 operates in the same manner as the fluidic energy transfer device of FIG. 19. Optional reaction mass 245 can be used to tune the system's resonant frequency.

Figure 26:
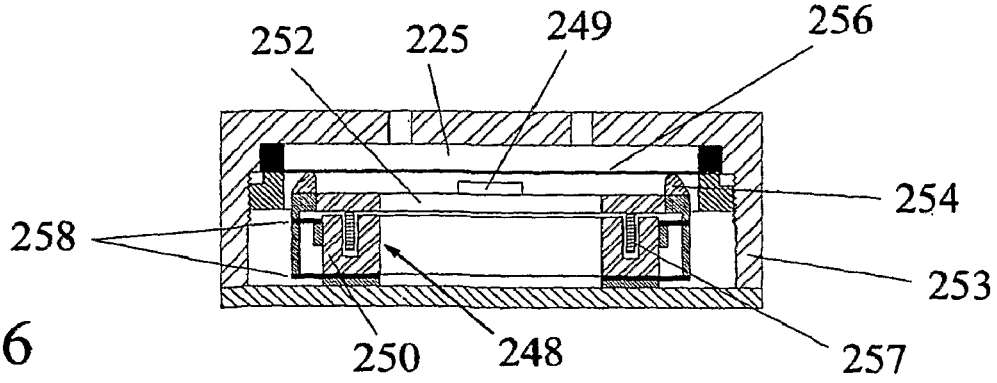
FIG. 26 and is a cross-sectional view of an off-axis driven embodiment of the present invention having a mechanically grounded voice-coil actuator which drives a diaphragm within a fluidic energy transfer device.

FIG. 26 illustrates an additional off-axis driving system using a grounded voice-coil actuator 248 having an annular permanent magnet section 250 being mechanically grounded at its bottom surface to housing 253 and having a voice-coil section 252 connected by springs 258 to permanent magnetic section 250. The top surface of voice coil section 252 is resiliently connected to diaphragm 256 by annular stand-off 254. When voice coil 257 is energized with an alternating current of frequency f, then the resulting magnetic forces cause voice-coil section 252 to vibrate with respect to permanent magnetic section 250 which in turn causes diaphragm 256 to also vibrate at frequency f. thereby transferring energy to the fluid within fluid chamber 255. If the drive frequency f is at or near the system resonance frequency, then the displacements of diaphragm 256 will be larger in proportion to the energy stored in the system resonance. Optional reaction mass 249 can be used to tune the system's resonant frequency.

Figure 27:
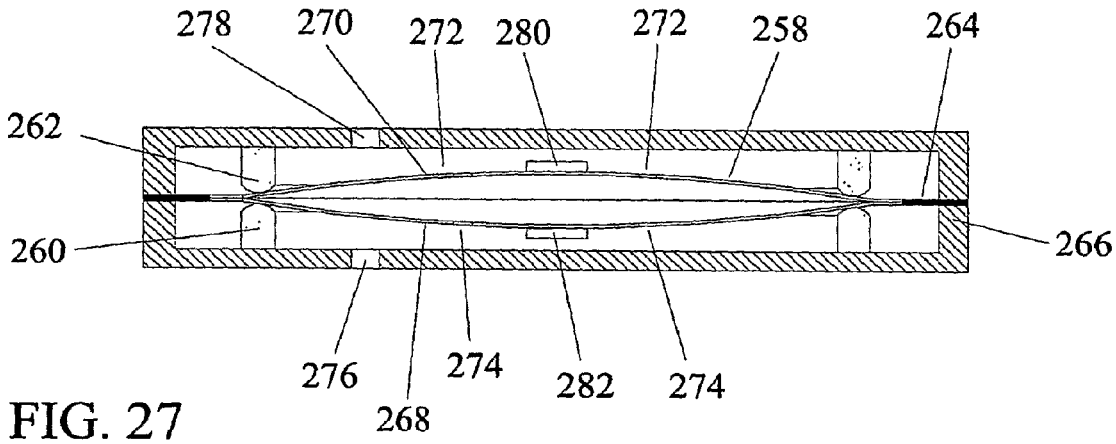
FIG. 27 and is a cross-sectional view of an off-axis driven embodiment of the present invention having dual mechanically grounded annular electro active actuators which drive a bellows compression chamber within a pump or compressor.

FIG. 27 illustrates an off-axis driven pump having a bellows 258 being attached around its perimeter to housing 266 via soft spring 264. Mechanically grounded actuators 260 and 262 are resiliently connected to bellows 258 near its perimeter with said actuators being energized so as to apply oppositely directed forces to bellows 258, thereby either increasing or decreasing the volume of bellows 258 depending on the direction of the applied forces. The upper diaphragm 270 of bellows 258 has outlet ports 272 and the lower diaphragm 268 of has inlet ports 274. As described previously, these ports will typically be covered with reed valves which open and closed in response to the changing pressure inside of bellows 258 and the reed valve materials used would need to be compliant enough to maintain a seal over the ports despite the bending of the diaphragms. With respect to placement of the reed valves, the ports in top diaphragm 270 could serve as either inlet parts or outlet ports and like wise with lower diaphragm 268. It is assumed in FIG. 27 that the inlet reed valve is installed on lower diaphragm 268 and the outlet reed valve is installed on upper diaphragm 270.

For the sake of explanation, it is assumed that actuators 260 and 262 are piezoceramic actuators although any of the actuators discussed in connection with the present invention could alternatively be used. In operation, actuators 260 and 262 are energized with an alternating electric field of frequency f and the resulting cyclic displacements of actuators 260 and 262 cause the volume of bellows 258 to vary at frequency f. The resulting time varying pressure within bellows 258 will cause fluid to be drawn into port 276 and dispelled from port 278. Optional reaction mass 280 and 282 can be used to tune the system's resonant frequency. Operating the device of FIG. 27 at or near its system resonance frequency will result in bellows displacements that become larger in proportion to the energy stored in the system.

An alternative design for the pump of FIG. 27 would be to replace actuator 262 with a passive stud having the same shape. Although the remaining actuator would have to provide more displacement to create the same volume metric change within bellows 258, the pump would still be operational.

Figure 28:
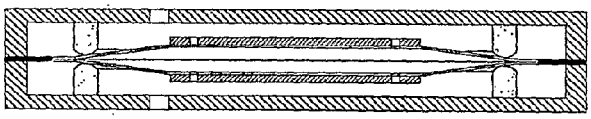
FIG. 28 is a cross-sectional view of an off-axis driven embodiment of the present invention having dual mechanically grounded annular electro active actuators which drive a dual-piston bellows compression chamber within a pump or compressor.

FIG. 28 shows another off-axis driven pump which is operationally similar to the pump of FIG. 27 except for the addition of two pistons to the pure bellows arrangement of FIG. 27. Otherwise the pump of FIG. 28 operates in the same manner as the pump of FIG. 27.

Figure 29:
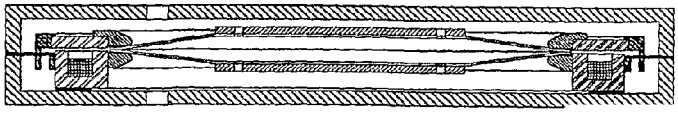
FIG. 29 is a cross-sectional view of an off-axis driven embodiment of the present invention having mechanically grounded VR actuator which drives a dual-piston bellows compression chamber within a pump or compressor.

FIG. 29 provides a variation on the pump of FIG. 28 by using a VR motor to apply the opposing forces to the perimeter of the individual piston/diaphragms.

Clamp Driving

In the previously described embodiments of the present invention, springs, bellows or other fluidic components are typically clamped to the housing body and a flexible portion of the spring or diaphragm is driven by an actuator. The characteristic difference of clamp driving is that the actuator drives the clamp point of the spring, diaphragm or other fluidic component. For sake of definition, the clamp-point or clamp-section of a bending member is the portion that cannot bend or flex due to the clamp, nevertheless the clamp point can usually move with respect to the device housing.

Axial Clamp Driving

Figure 30:
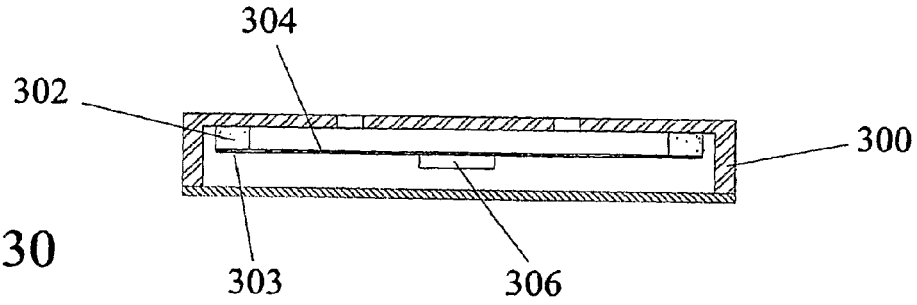
FIG. 30 is a cross-sectional view of an axial clamp-driven embodiment of the present invention having mechanically grounded annular electro active actuator which drives a diaphragm within a fluid energy transfer device.

FIG. 30 illustrates an embodiment of axial clamp driving where a fluid energy transfer device has an enclosure 300, an annular electro active actuator 302, a diaphragm 304 and an optional tuning mass 306. The top surface of actuator 302 is mechanically grounded to housing 300 in the bottom surface of actuator 302 is attached to diaphragm 304. The connection between actuator 302 and diaphragm 304 comprises the clamp point 303 of diaphragm 304. Vibrational displacements of actuator 302 are in the same direction as the vibrational displacements of diaphragm 304. It is intended that the electro-active actuator type will be chosen so that the principle vibrations of actuator 322 will be axial. Vibrational displacements of clamp point 303 are transferred to diaphragm 304. If the frequency f of the vibrational displacements is below the higher ordered resonant modes of the diaphragm, then the diaphragm will respond by oscillating in its fundamental axial mode at frequency f. If the driving frequency f is at or near the system fundamental resonance than energy will be stored in the system resonance and the displacements of diaphragm 304 will increase proportionately to the stored energy. The system resonance can be tuned using optional mass 306.

Figure 31:
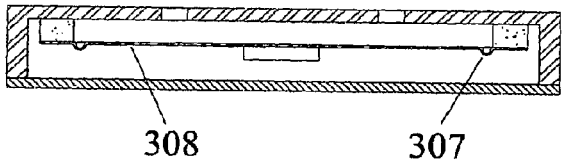
FIG. 31 is a cross-sectional view of an axial clamp-driven embodiment of the present invention having mechanically grounded annular electro active actuator which drives a convoluted diaphragm within a fluid energy transfer device.

The embodiment of the FIG. 31 operates in a similar manner to the embodiment of FIG. 30 except for the addition of a convoluted section 307 of diaphragm 308. Convoluted section 307 adds axial flexibility to diaphragm 308 by reducing its spring stiffness, thereby allowing diaphragm 308 to achieve larger displacements. Other diaphragms enhancements that can be used to increase a diaphragm's displacement by reducing its spring stiffness including for example so called "living hinges" (see U.S. Pat. No. 4,231,287).

Since the actuators of FIGS. 30 and 31 will all undergo X, Y and Z axis dimensional changes, the resiliency of the actuator-to-housing attachment must be taken into consideration in order to avoid overly constraining the vibration of the actuators, as discussed previously. Further, the optional diaphragm tuning mass can be used in the embodiments of FIGS. 30-35 to tune the system resonance.

Figure 32:
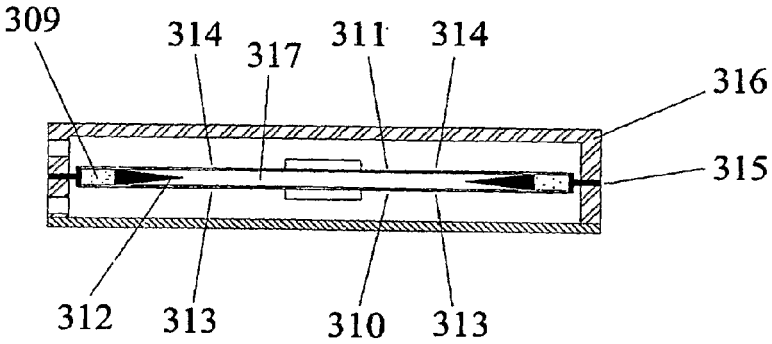
FIG. 32 is a cross-sectional view of an axial clamp-driven embodiment of the present invention having an annular electro active actuator which drives two diaphragms within a fluid energy transfer device.

FIG. 32 illustrates a pump embodiment of axial clamp driving where an annular electro-active actuator 309 is attached to diaphragms 313 and 314 and is also attached to pump housing 316 by flexible mounting ring 315. Annular wedge 312 reduces the clearance volume within compression chamber 317. Vibrational displacements of actuator 309 are in the same direction as the displacements of diaphragms 313 and 314. The flexing of actuator 309 will cause diaphragms 313 and 314 to oscillate 180° out of phase with each other.

Figure 32A:
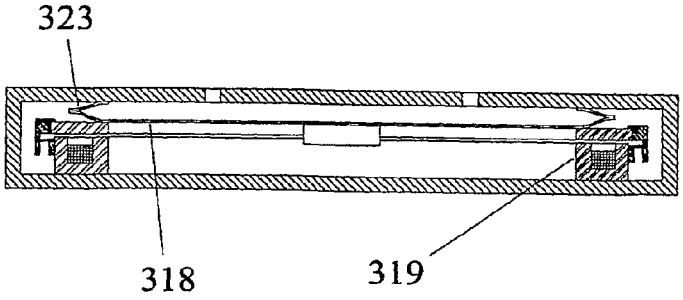
FIG. 32A is a cross-sectional view of an axial clamp-driven embodiment of the present invention having mechanically grounded variable reluctance actuator which drives a diaphragm within a fluid energy transfer device.

FIG. 32A illustrates another embodiment of axial clamp driving having a variable reluctance actuator 319 driving the clamp point of diaphragm 318. Diaphragm 318 is sealed at its perimeter with a flexible bellows-type seal 323. Otherwise the embodiment of FIG. 32A operates in the same manner as the embodiments of FIGS. 30 and 31.

Radial Clamp Driving

In the Following embodiments the forces exerted on the clamp point are in the radial direction.

Figure 33:
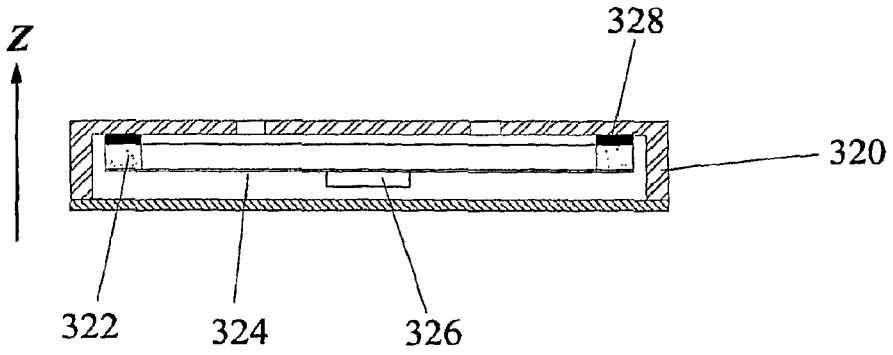
FIG. 33 is a cross-sectional view of a radial clamp-driven embodiment of the present invention having mechanically grounded annular electro active actuator which drives a diaphragm within a fluid energy transfer device.

FIG. 33 illustrates an embodiment of radial clamp driving where a fluid energy transfer device has an enclosure 320, an annular electro active actuator 322, a diaphragm 324 and an optional tuning mass 326. The top surface of actuator 322 is resiliently mounted to housing 320 via flexible mount 328 so as to allow radial flexing of actuator 322. Diaphragm 324 is attached to the bottom surface of actuator 322. It is intended that the electro-active actuator type will be chosen so that the principle vibrations of actuator 322 will be radial. Radial vibrational displacements of actuator 322 will create oscillating radial tensile stresses in diaphragm 324, which can be converted into Z axis vibrations of diaphragm 324. Initiation of this radial-to-axial conversion process is assisted by the fact that actuator 322 also vibrates in the direction of the diaphragm's displacement (i.e. Z axis), although the axial displacement amplitude may be smaller than the radial displacement amplitude. Radial vibrational displacements of actuator 322 at frequency f can result in axial vibrational displacements of diaphragm 324 at frequency f or f/2 depending on the construction of diaphragm 324 (for example, flat diaphragm, pre-stressed bowed diaphragm, degree of axial and/or radial stiffness and/or nonlinearity, etc.).

If diaphragm 324 is excited at a frequency f that is below the higher ordered resonant modes of the diaphragm 324, then the diaphragm will respond by oscillating in its fundamental Z axis mode at frequency f. If diaphragm 324 is excited to axially oscillate at a frequency f that is near or equal to the system fundamental resonance frequency, then energy will be stored in the system resonance and the displacements of diaphragm 324 will increase proportionately to the stored energy. The system resonance can be tuned using optional mass 326.

Figure 34:
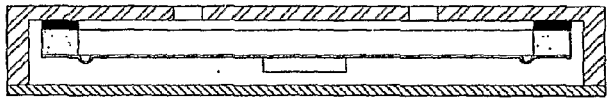
FIG. 34 is a cross-sectional view of a radial clamp-driven embodiment of the present invention having mechanically grounded annular electro active actuator which drives a convoluted diaphragm within a fluid energy transfer device.
Figure 35:
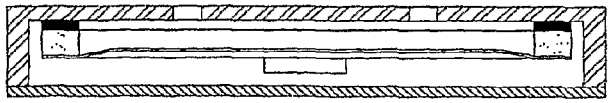
FIG. 35 is a cross-sectional view of a radial clamp-driven embodiment of the present invention having mechanically grounded annular electro active actuator which drives a convoluted diaphragm within a fluid energy transfer device.

FIGS. 34 and 35 illustrate the use of convoluted diaphragms for the purpose of increasing diaphragm displacements and otherwise operate in the same manner as the embodiment in FIG. 33. Other diaphragm enhancements that can be used to increase a diaphragm's displacement by reducing its spring stiffness include so called "living hinges" (see U.S. Pat. No. 4,231,287).

The embodiments of FIGS. 30-35 can all be used to drive a secondary piston as shown in other embodiments of the present invention such as in FIGS. 17 and 20.

Figure 36:
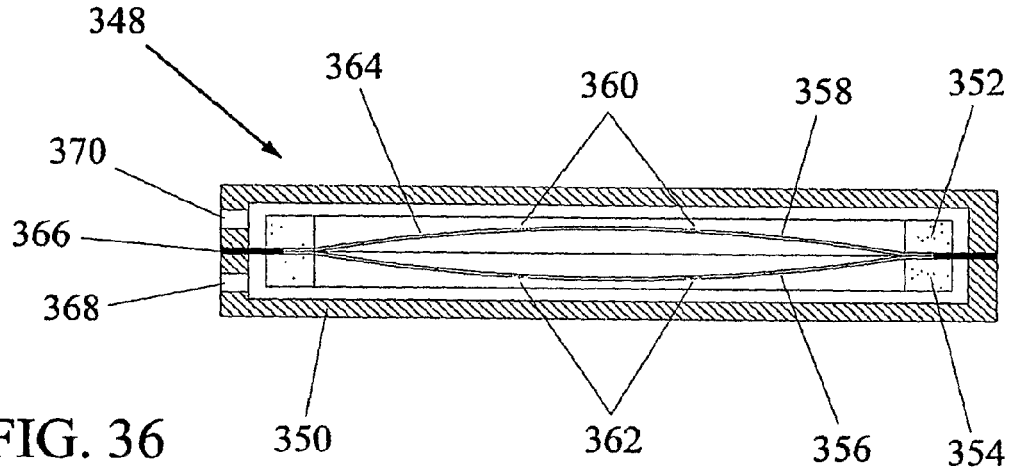
FIG. 36 is a cross-sectional view of a radial clamp-driven embodiment of the present invention having dual annular electro active actuators which drive a bellows compression chamber within a pump or compressor.

FIG. 36 illustrates another embodiment of radial clamp driving where a pump 348 has a pump housing 350 and a bellows 364 being attached around its perimeter to housing 350 via soft annular spring 366. Electro-active actuators 352 and 354 are rigidly connected to the perimeter of bellows 364 with said actuators being energized so as to apply radial forces to bellows 364, thereby either increasing or decreasing the volume of bellows 364 depending on the radial direction of the applied forces. It is intended that the electro-active actuator type will be chosen so that the principle vibrations of actuators 352 and 354 will be radial. The upper diaphragm 358 of bellows 258 has outlet ports 360 and the lower diaphragm 356 of bellows 364 has inlet ports 362. As described previously, these ports will typically be covered with reed valves which open and closed in response to the changing pressure inside of bellows 364 and the reed valve materials used would need to be compliant enough to maintain a seal over the ports despite the bending of the bellows diaphragms. With respect to placement of the reed valves, the ports in top diaphragm 358 could serve as either inlet parts or outlet ports and like wise with lower diaphragm 356. It is assumed in FIG. 36 that the inlet reed valve is installed on lower diaphragm 356 and the outlet reed valve is installed on upper diaphragm 358.

For the sake of explanation, it is assumed that actuators 352 and 354 are piezoceramic actuators although any of electro-active actuators capable of exerting radial forces could be used. In operation, actuators 352 and 354 are energized with an alternating electric field of frequency f and the resulting cyclic radial displacements of actuators 352 and 354 cause the volume of bellows 364 to vary at frequency f. The resulting time varying pressure within bellows 364 will cause fluid to be drawn into port 368 and discharged from port 370. Optional reaction masses could be added to the upper and lower bellows diaphragms to tune the system's resonant frequency.

Figure 37:
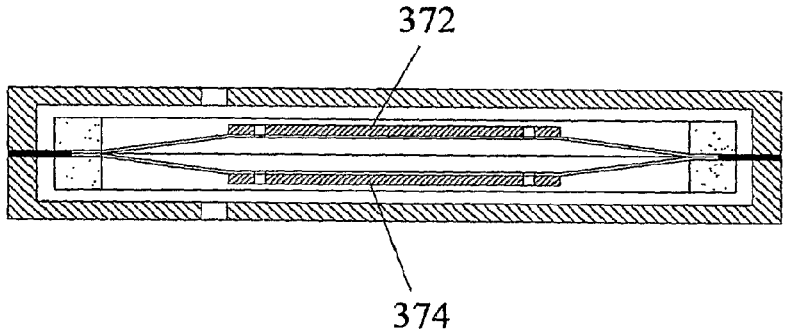
FIG. 37 is a cross-sectional view of a radial clamp-driven embodiment of the present invention having dual annular electro active actuators which drive a dual-piston bellows compression chamber within a pump or compressor.

FIG. 37 shows another radial clamp driving pump which is operationally similar to the pump of FIG. 36 except for the addition of pistons 372 and 374 to the pure bellows arrangement of FIG. 36. Otherwise the pump of FIG. 37 operates in the same manner as the pump of FIG. 36.

In FIGS. 33-37 all of the diaphragms could be mounted within the inner diameter of the annular actuators although this may require tighter tolerances in the diaphragm and actuator dimensions.

Flex Radial Driving

Figure 37A:
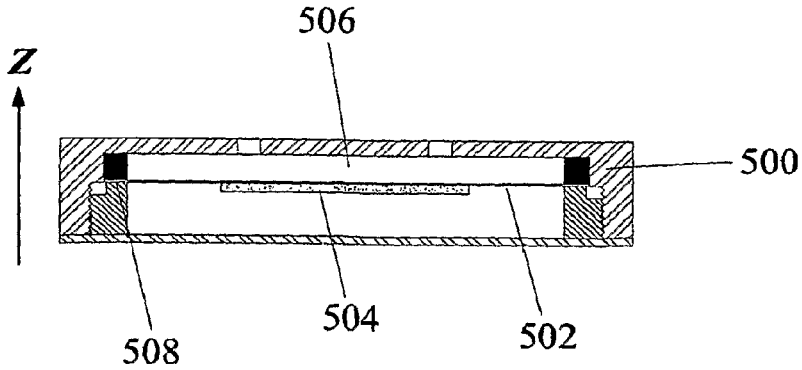
FIG. 37A is a cross-sectional view of a flex radial driven embodiment of the present invention having a single diaphragm with a radially flexing actuator.

FIG. 37A illustrates a flex radial driving embodiment of the present invention. A diaphragm 502 has a disk-shaped electro-active actuator 504 attached to its center. Diaphragm 502 is clamped around its perimeter at annular clamp 508, thereby being attached to enclosure 500. Fluid chamber 506 is bounded by diaphragm 502, actuator 504, and enclosure 500. For the sake of a functional explanation, actuator 504 is assumed to be constructed from a piezoceramic material, but could in turn be constructed from any number of other electro-active materials. The polarization of actuator 504 is such that the application of a voltage of given polarity causes it to expand or contract principally in its radial dimension.

In operation, an alternating voltage is applied to actuator 504. The resulting radial vibrational displacements of actuator 504 create oscillating radial tensile stresses within diaphragm 502 between actuator 504 and annular clamp 508. These oscillating tensile stresses are converted into Z axis vibrations of diaphragm 502, with actuator 504 of course traveling along with the Z axis vibrations of diaphragm 502. Initiation of this radial-to-axial conversion process is assisted by the fact that actuator 504 also vibrates in the direction of the diaphragm's axial displacement, although the actuator's axial displacement amplitude may be smaller than the radial displacement amplitude. Radial vibrational displacements of actuator 504 at frequency f can result in Z axis vibrational displacements of diaphragm 502 at frequency f or f/2 depending on the construction of diaphragm 502 (for example, flat diaphragm, pre-stressed bowed diaphragm, degree of axial and/or radial stiffness and/or nonlinearity, etc.). If the embodiment of FIG. 37A is driven at a frequency such that diaphragm 502 oscillates axially at a frequency f that is near or equal to the system fundamental resonance frequency, then energy will be stored in the system resonance and the displacements of diaphragm 502 will increase proportionately to the stored energy.

The bond between diaphragm 502 and actuator 504 can cause actuator 504 and diaphragm 502 to bend slightly over the area of the bond just like a typical uni-morph bender actuator, with the bending shape being either concave or convex depending on the polarity of the voltage applied. With respect to the Z axis displacements of diaphragm 502, actuator 504 will act like a piston, in a manner similar to the other embodiments of the present invention having pistons with flexible surrounds.

Figure 37B:
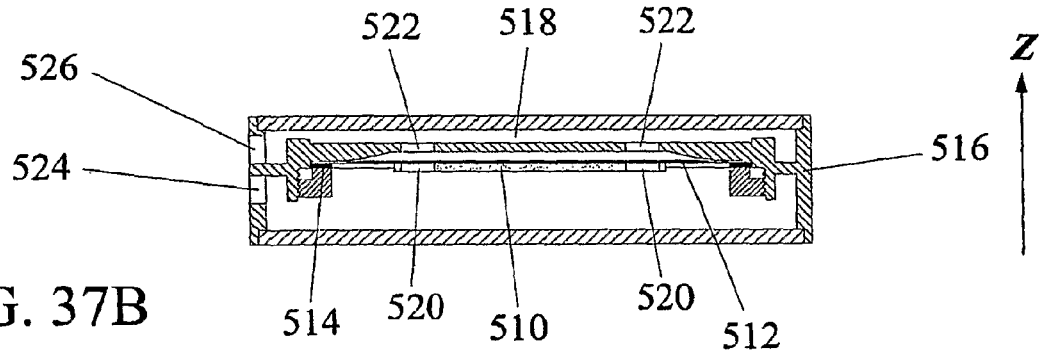
FIG. 37B is a cross-sectional view of a flex radial driven pump embodiment of the present invention having a single diaphragm with a radially flexing actuator.

FIG. 37B illustrates another flex radial driving pump embodiment of the present invention. A diaphragm 512 has a disk-shaped electro-active actuator 510 attached to its center. Diaphragm 512 is clamped around its perimeter at annular clamp 514, thereby being attached to enclosure 516. Actuator 510 has and inlet ports 520 and enclosure 516 as outlet ports 522. As in other embodiments of the present invention, inlet ports 520 and outlet ports 522 will be equipped with reed valves or other types of valves as appropriate. Fluid chamber 518 is bounded by diaphragm 512, actuator 510, and enclosure 516. For the sake of a functional explanation, actuator 510 is assumed to be constructed from a piezoceramic material, but could in turn be constructed from any number of other electro-active materials. The polarization of actuator 510 is such that the application of a voltage of given polarity causes it to expand or contract principally in its radial dimension.

In operation, an alternating voltage is applied to actuator 510. The resulting radial vibrational displacements of actuator 510 create oscillating radial tensile stresses within diaphragm 512 between actuator 510 and annular clamp 514. These oscillating tensile stresses are converted into Z axis vibrations of diaphragm 512, with actuator 510 of course traveling along with the Z axis vibrations of diaphragm 512. Initiation of this radial-to-axial conversion process is assisted by the fact that actuator 510 also vibrates in the direction of the diaphragm's axial displacement, although the actuator's axial displacement amplitude may be smaller than the radial displacement amplitude. Radial vibrational displacements of actuator 510 at frequency f can result in Z axis vibrational displacements of diaphragm 502 at frequency f or f/2 depending on the construction of diaphragm 512 as discussed previously. The axial oscillations of diaphragm 112 and actuator 110 will cause fluid to be drawn into port 524 and discharged from port 526. If the embodiment of FIG. 37B is driven at a frequency such that diaphragm 512 oscillates axially at a frequency f that is near or equal to the system fundamental resonance frequency, then energy will be stored in the system resonance and the displacements of diaphragm 502 will increase proportionately to the stored energy.

Figure 37C:
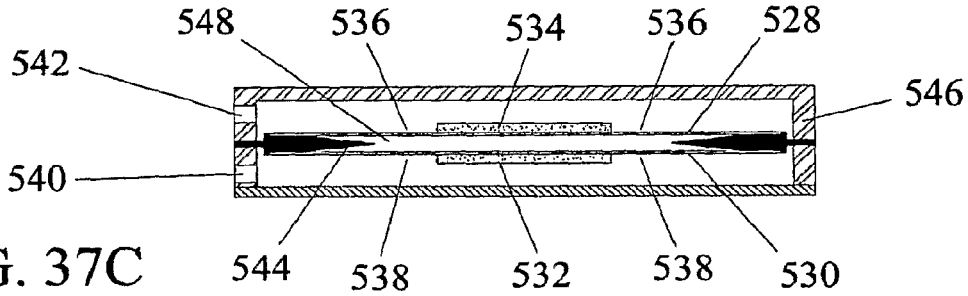
FIG. 37C is a cross-sectional view of a flex radial driven pump embodiment of the present invention having dual diaphragms with a radially flexing actuators.

FIG. 37C illustrates a further flex radial driving pump embodiment of the present invention. A first diaphragm 536 has a disk-shaped electro-active actuator 534 attached to its center and is attached around its perimeter to annular wedge 544, which in turn is attached to enclosure 546. A second diaphragm 538 has a disk-shaped electro-active actuator 532 attached to its center and is attached around its perimeter to annular wedge 544. Diaphragms 528 and 530 are provided with respective outlet ports 536 and inlet ports 538, which would all typically be equipped with reed valves or other types of valves as appropriate. The first and second diaphragms and respective actuators operate in the manner as the embodiments of FIGS. 37A and 37B causing an oscillation of fluid chamber 548,*m* which in turn causes fluid to be drawn into port 540 and discharged from port 542.

Figure 37D:
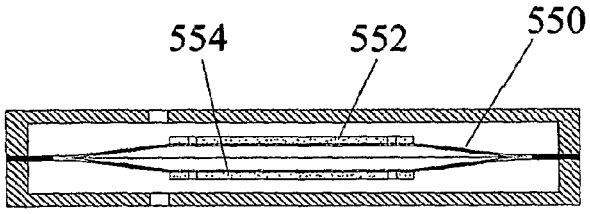
FIG. 37D is a cross-sectional view of a flex radial driven pump embodiment of the present invention having a bellows section with two radially flexing actuators.

FIG. 37D illustrates a further flex radial driving pump embodiment of the present invention having a bellows 550 and dual radial flexing actuators 552 and 554. The embodiment of FIG. 37E operates in a similar manner to the embodiment of FIG. 37D except for its linear rather than non-parametric operation. However, some pumping performance can be achieved with a parametric drive frequency.

Figure 37E:
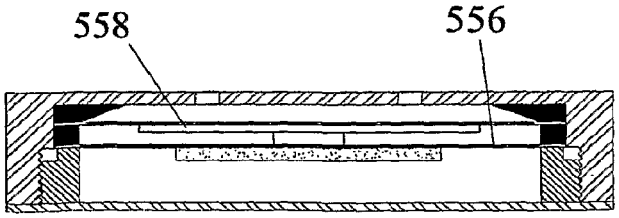
FIG. 37E is a cross-sectional view of a flex radial driven embodiment of the present invention having a diaphragm with a radially flexing actuator that drives a secondary piston.
Figure 37E:
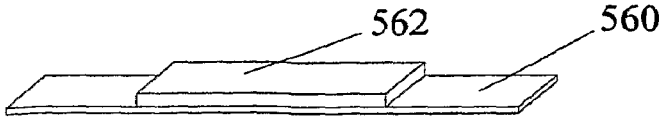

FIG. 37E illustrates a further flex radial driving embodiment of the present invention where a flex radial diaphragm 556, the operation of which has been previously described, drives a secondary piston 558 having a flexible surround. Flex radial diaphragm 556 could be replaced with a flex longitudinal spring 560 having a rectangular electro-active actuator 562 bonded thereto. Any number of other spring topologies could also be used.

Another embodiment of flex radial driving would be to sandwich flex radial diaphragm 556 or flex longitudinal spring 560 of FIG. 37E between two halves of a bellows, such as halves 358 and 356 of bellows 364 in FIG. 36. The flex radial or flex longitudinal elements would apply oscillating radial forces to the perimeter of the bellows, thereby causing the bellow's volume to oscillate with the bellows being applicable to a number of embodiments of the present invention. In case of a diaphragm holes or vents would be needed in the diaphragm to allow fluid flow through the bellows. Convoluted sections could be added to the diaphragms of the embodiments of FIGS. 37A, 37B and 37C.

Edge Driving

Figure 38:
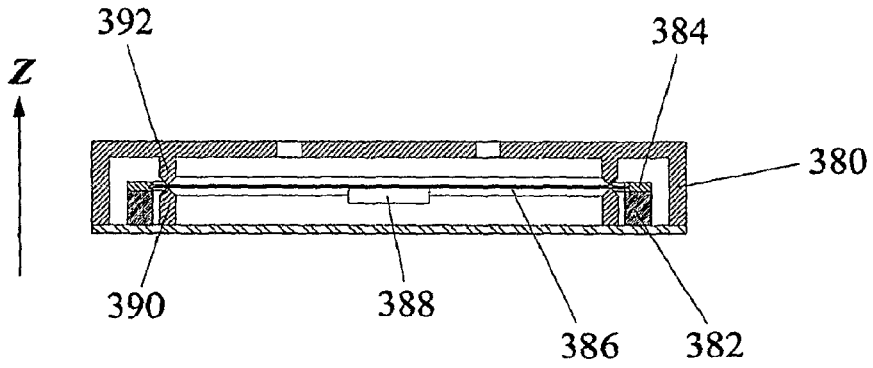
FIG. 38 is a cross-sectional view of an edge-driven embodiment of the present invention having an annular electro-active actuator which drives the edge of a diaphragm outside of its clamp circle.

FIG. 38 illustrates an edge driven diaphragm embodiment of the present invention, having an enclosure 380, a diaphragm 386, an optional tuning mass 388, an annular electro active actuator 382 and annular knife edge clamps 390 and 392. The bottom surface of the actuator 382 is attached to enclosure 380. The top surface of actuators 382 is attached to the edge, or perimeter, of diaphragm 386 via connector 384. When actuator 382 is energized it creates a force in parallel with the Z axis. If the force is in the −Z direction, then the center of diaphragm 386 will move in the +Z direction. Likewise, if the force is in the +Z direction, then the center of diaphragm 386 will move in the −Z direction.

If diaphragm 386 is excited by actuator 382 at a frequency f that is below the higher ordered resonant modes of the diaphragm 386, then the diaphragm will respond by oscillating in its fundamental axial mode at frequency f. If diaphragm 386 is driven at a frequency f that is near or equal to the system fundamental resonance frequency, then energy will be stored in the system resonance and the displacements of diaphragm 386 will increase proportionately to the stored energy. The system resonance can be tuned using optional mass 388.

Figure 39:
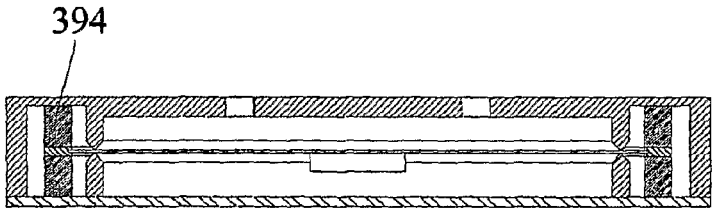
FIG. 39 is a cross-sectional view of an edge-driven embodiment of the present invention having dual annular electro-active actuators which drives the edge of a diaphragm outside of its clamp circle.

The embodiment of FIG. 39 operates in the same manner as the embodiment of FIG. 38, except for the addition of a second annular electro active actuator 394. The forces generated by actuator 394 will be in the same direction as the forces generated by actuator 382 of FIG. 38.

Figure 40:
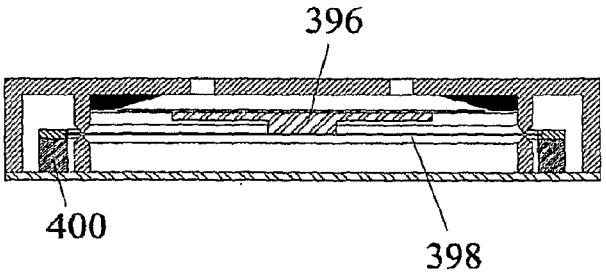
FIG. 40 is a cross-sectional view of an edge-driven embodiment of the present invention having an annular electro-active actuator which drives the edge of a diaphragm outside of its clamp circle, with said diaphragm in turn driving a piston.

In FIG. 40 the edge driven arrangement of FIG. 38 is used to drive a piston 396. The mechanical amplification created by diaphragm 398 results in displacements of piston 396 which are larger than the displacements of actuator 400. Within the scope of the current invention, diaphragm 398 could be replaced with a simple leaf spring or any number of other spring-type designs and materials capable of bending and providing mechanical amplification.

Figure 40A:
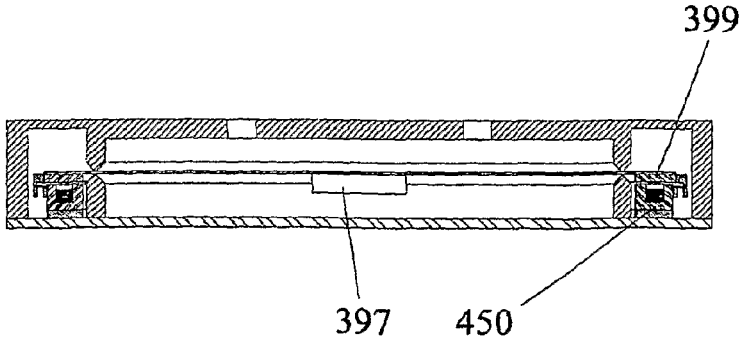
FIG. 40A is a cross-sectional view of an edge-driven embodiment of the present invention having an annular variable reluctance actuator which drives the edge of a diaphragm outside of its clamp circle.

The embodiment of FIG. 40A operates in the same manner as the embodiment of FIG. 38 except that the electro-active actuator of FIG. 38 has been replaced with variable reluctance actuator 450. Armature 399 of actuator 450 and the diaphragm mass 397 are always moving in opposite directions, so by choosing the correct masses the forces that they exert on the enclosure can be reduced or canceled, thereby reducing enclosure vibrations and the resulting noise.

The present invention can use piezoceramic uni-morph actuators that are pre-stressed such as the Thunder Actuators developed by NASA and covered by U.S. Pat. Nos. 5,632,841 and 6,734,603. The present invention can also use simple laminar uni-morph or poly-morph benders that are flat and have no pre-stress and in many cases these actuators are preferred since the present invention does not require large piezo displacements, but is instead designed to use high-force small-displacement actuators. (A uni-morph piezo bender is typically constructed from a slab of piezoceramic bonded to a metal sheet substrate). Simple laminar uni-morphs have the further advantaged that their manufacturing cost is quite low when compared to pre-stressed actuators. Another advantage of using low displacement piezo uni-morphs is that "harder" ceramics can be used that offer much higher electro-mechanical transduction efficiencies when compared to the softer ceramics that must be used in high-displacement benders. These harder ceramics are particularly more efficient than the softer ceramics above 100 Hz. Operating at higher frequencies is particularly desirable for small pumps and compressors to provide high flow rates in a small package, due to the large number of pumping cycles per second.

Driving of Resonant Acoustic Loads

The fluidic energy transfer devices of the present invention can also be used for driving high-power resonant acoustic loads, such as acoustic compressors and thermoacoustic engines. U.S. Pat. Nos. 5,515,684, 5,319,938, 5,579,399, 6,230,420 disclosure the principles of designing high energy density acoustic resonators, specific resonator shapes and the applications of high energy density acoustic resonators, the contents of which are all incorporated herein by reference in their entirety.

Figure 41:
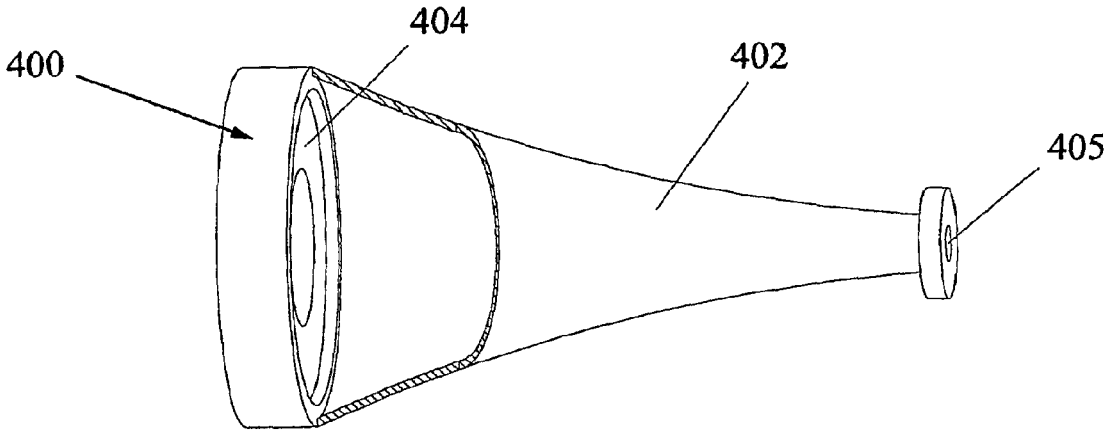
FIG. 41 illustrates a fluid energy transfer device of the present invention driving an acoustic resonator shown in partial cross-section.

FIG. 41 illustrates the use of the current invention in driving longitudinal standing waves within the resonator. A fluidic energy transfer device 400 of the present invention is rigidly connected to the wide end and of resonator 402. Energy transfer device 400 has a piston and/or diaphragm 404 which is driven to vibrate at a given longitudinal acoustic mode of resonator 402, as is well known in the art and as described in the above patent references. Any of the embodiments of the present invention could be used to vibrate the diaphragm and/or piston of energy transfer device 400. Energy transfer device 400 could have either a pure diaphragm such as in FIG. 3 or a piston with a flexible surround such as in FIG. 20 and any number of different actuators could be used. Double diaphragms, such as in FIG. 32, could also be used to drive radial modes, wherein fluid chamber 317 would serve as the acoustic resonator. The two diaphragms could transfer more power into the acoustic standing wave. For applications to acoustic compressors the ports in diaphragms 313 and 314 of FIG. 32 could be moved closer to the center to take advantages of the larger acoustic pressure amplitudes.

Figure 42:
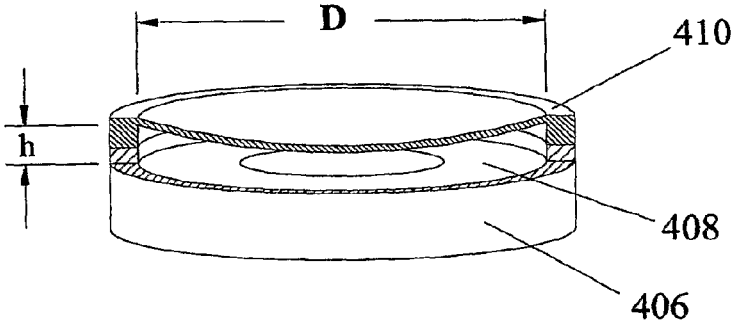
FIG. 42 illustrates a fluid energy transfer device of the present invention driving another acoustic resonator shown in partial cross-section.

FIG. 42 illustrates the use of the current invention in driving radial standing waves within an acoustic resonator. A fluidic energy transfer device 406 of the present invention is rigidly connected to the radial resonator 410. The fluid-filled space within resonator 410 is bounded by piston/diaphragm 408 and resonator 410 having a diameter D and a height h which varies axi-symmetrically with R, with $h_{max}$ at r=D/2 and $h_{min}$ at r=0. Energy transfer device 406 has a piston/diaphragm 408, which is driven to vibrate at a given radial acoustic mode frequency of resonator 402. The best energy transfer will occur when driving the lowest ordered radial mode. Any of the embodiments of the present invention could be used to vibrate the diaphragm/piston of energy transfer device 406. Energy transfer device 406 could have either a pure diaphragm such as in FIG. 3 or a piston with a flexible surround such as in FIG. 20 and any number of different actuators could be used. As disclosed in U.S. Pat. No. 5,515,684, the shape of an acoustic resonator can be used to suppress acoustic shock formation and promote high energy densities and large acoustic pressure amplitudes. The shape of resonator 410 will tend to reduce the thermo-acoustic losses associated with a given acoustic pressure amplitude measured at r=0. If fluidic energy transfer device of FIG. 42 were converted to an acoustic compressor, then the compressor valves would be located at the center to take advantage of the larger acoustic pressure amplitudes. Many other resonator shapes can be used and will be determined by the particular application, as is well known in the art.

Figure 43:
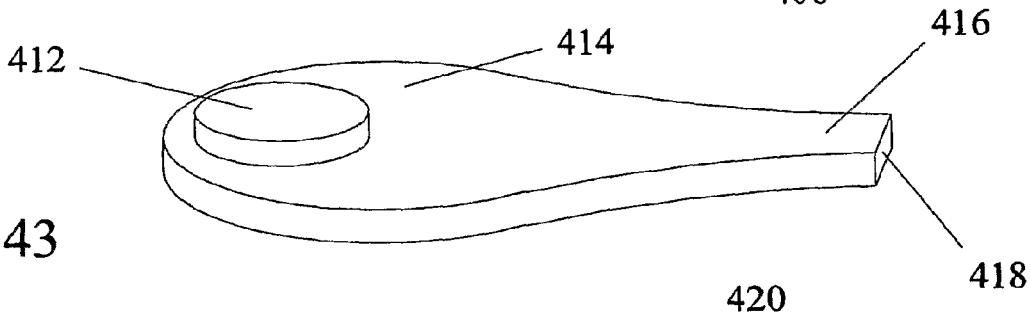
FIG. 43 illustrates a fluid energy transfer device of the present invention driving a flat acoustic resonator.

FIG. 43 illustrates a flat acoustic resonator 414 being driven by a fluidic energy transfer device 412 of the present convention. Resonator 414 is designed to support longitudinal standing waves. The largest acoustic pressure amplitudes will exist at the small end 416, which is where compressor valves would be placed if resonator 414 was used as an acoustic compressor. Multiple fluidic energy transfer devices can be placed on either side or along the length of resonator 414 to increase power input.

One of the challenges in miniaturizing acoustic compressors is the design of an actuator that can provide the power needed for practical applications. When adapted to driving small acoustic resonators, the present invention provides high-power low-cost actuators for miniaturized acoustic compressors and for the many other applications of small acoustic resonators.

Resonant Synthetic Jets

Figure 44:
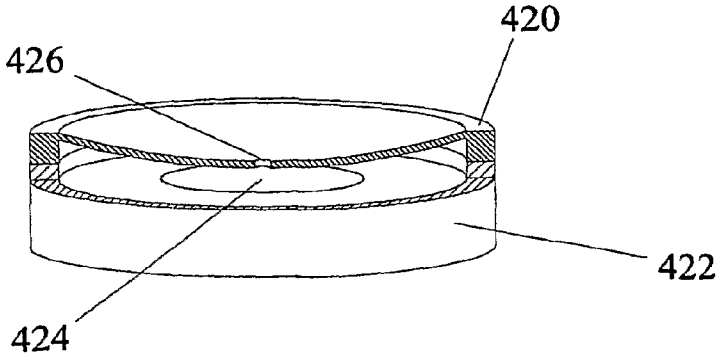
FIG. 44 illustrates a fluid energy transfer device of the present invention driving a resonant synthetic jet.

When driven by the present invention, or any of the embodiments of PCT Application NO. PCT/US2005/046557, acoustic resonators can be used to increase the flow performance of synthetic jets. For example, FIG. 44 illustrates an acoustically resonant synthetic jet having a radial acoustic resonator 420 driven by a fluidic energy transfer device 422 of the present invention as described in the embodiment of FIG. 42. A synthetic jet port 426 is located at the center 424 of resonator 420. The high levels of energy that can be stored in the acoustic resonance will result in large pressure oscillations, which in turn can produce large oscillating flows through port 426. These large oscillating flows will create pulsating jet flow outside of resonator 420 as is well known in the art.

A resonator, like that shown in FIG. 41, can be used as a resonant synthetic jet by leaving throat 405 open. Upon excitation of a longitudinal standing wave mode, very large oscillating flows can be established in throat 405. Typically the lowest ordered longitudinal modes will provide the highest external pulsating jet flow. A resonator like that shown in FIG. 41, being approximately 11 inches in length, provided measured jet flows of over 100 CFM at roughly 800 Hz. Another resonator like that shown in FIG. 41, being approximately 2.5 inches in length, provided measured jet flows of over 5 CFM at roughly 4000 Hz for about 2.7 CFM/watt and can provide higher flows if more power is applied. The resonator of FIG. 43 could provide similar results if its throat 418 were left open. Any number of synthetic jet ports can be placed in any number of locations around the exterior surface of an acoustic resonator, all of which are considered within the scope of the present invention.

While the present invention enables miniaturization of fluidic energy transfer devices, the scope of the present invention is in no way limited to embodiments of any given size. The present invention can be scaled up beyond the mezzo size range and down into the MEMS size range. Various embodiments and enhancements of the present invention are disclosed herein and it will occur to those skilled in the art to use many different combinations of these embodiments and enhancements. All of the various combinations of these embodiments will be determined by the requirements of a given application and are considered within the scope of the present invention. For example, the number of valves used, whether or not added axial stability springs are required, the use of one or two diaphragms, actuators driving springs or diaphragms which in turn drive pistons, the number of actuators used in a single device, whether or not controls are needed, the types of methods used for joining components, the type of actuator used in a given embodiment, the types of seals used, and the use of pumps in series or parallel will all be determined by the performance and cost requirements of a given application.

Other examples of embodiments within the scope of the present invention that will occur to those skilled in the art would be to locate a single bender actuator (or other actuator) between two back-to-back fluidic diaphragms or pistons with each diaphragm or piston having its own compression chamber so as to drive the two diaphragms or pistons with the single actuator in a push-pull configuration. It will appear obvious to those skilled in the art to use both sides of a diaphragm or piston to form separate compression chambers and to stage those compression chambers by having valves on the diaphragm which allow fluid to pass from one chamber to the next. Also, the diaphragm reaction masses illustrated herein are shown as disks located at the center of the diaphragm, but could take many other forms and could be mounted off-center, such as in the case of an annular mass. In addition, many types of compressor and/or pump valves can be used in the present invention. For example, the moving piston or diaphragm of a given embodiment can be used to actuate inlet and outlet valves such as in the case of a sliding shaft valve, which would slide into a port and cyclically open and close an inlet or outlet port. Pumps of the present invention can be scaled up or down in size and can be used in closed cycle systems as well as open cycle systems as will be evident to those skilled in the art.

The present invention can use piezoceramic bimorph actuators that are pre-stressed such as the Thunder Actuators developed by NASA resulting in U.S. Pat. Nos. 5,632,841 and 6,734,603. The present invention can also use simple laminar bi-morphs that are flat and have no pre-stress and in many cases these actuators are preferred since the present invention does not require large actuator displacements, but is instead designed to use high-force small-displacement actuators. Simple laminar bi-morphs have the further advantaged that their manufacturing cost is quite low when compared to pre-stressed actuators.

All of the fluidic energy transfer embodiments of the present invention can also be used to drive conventional pistons with sliding seals and applied to pumps, compressors and the many other fluidic applications. However, care must be taken to assure that the fictional losses of the sliding seals are not excessive, since this would lower the device's energy efficiency.

The embodiments of the present invention can be driven at any frequency within the scope of the present invention. While performance advantages can be provided by operating the present invention at drive frequencies that are equal to or close to the system resonance, the scope of the present invention is not limited to the proximity of the drive frequency and the system resonance frequency. When drive frequencies are close enough to the system resonance that energy is stored in the resonance, then diaphragm and/or piston displacement amplitudes will increase in proportion to the stored energy. The closer the drive frequency is to the instantaneous system resonance frequency, the greater the stored energy, the greater the piston and/or diaphragm displacement and the greater the fluid energy transfer. Operation of the present invention, either with or without stored energy, is considered within the scope of the present invention.

It is also understood that the diaphragms of the present invention can be made of many different materials such as metals, plastics or elastomers. Whether diaphragms or piston surround materials behave as plates or membranes depends on the materials used and the deflections required by a given application and all of these materials and their behaviors are considered within the scope of the present invention. Further, various piston shapes could be used to provide different advantages. For example, in order to provide light weight pistons, conical piston shapes could be used to increase stiffness while using thinner lightweight materials. In this case, the compression chamber could also have a conical shape to receive the conical piston thereby avoiding excessive clearance volumes. Many other geometrical piston shapes could be used to provide similar advantages, all of which will be obvious to one skilled in the art. It is further understood that in many of the embodiments of the present invention diaphragms can be substituted for pistons and pistons can be substituted for diaphragms, which will be obvious to one skilled in the art.

The PCT Application No. PCT/US2005/046557, which has been incorporated by reference, discloses further embodiments, applications, controllers and control schemes and any combinations of these embodiments with the present invention will be obvious to one skilled in the art and are considered within the scope of the present invention.

Applications of the present invention for transferring kinetic energy, pressurization energy and acoustic energy to fluids could include for example, compressing, pumping, mixing, atomization, synthetic jets, fluid metering, sampling, air sampling for bio-warfare agents, ink jets, filtration, or driving physical changes due to chemical reactions, or other material changes in suspended particulates such as comminution or agglomeration, or a combination of any of these processes, to name a few. Applications for pump and compressor embodiments of the present invention include MEMs and MESO-sized pumps and compressors for micro fuel cells in portable electronic devices such as portable computing devices, PDAs and cell phones; self-contained thermal management systems that can fit on a circuit card and provide cooling for microprocessors and other semi-conductor electronics; and portable personal medical devices for ambulatory patients.

The foregoing description of some of the embodiments of the present invention have been presented for purposes of illustration and description. In the drawings provided, the subcomponents of individual embodiments provided herein are not necessarily drawn in proportion to each other, for the sake of functional clarity. In an actual product, the relative proportions of the individual components are determined by specific engineering designs. The embodiments provided herein are not intended to be exhaustive or to limit the invention to a precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. Although the above description contains many specifications, these should not be construed as limitations on the scope of the invention, but rather as an exemplification of alternative embodiments thereof.

What is claimed is:

1. A fluid energy transfer device, comprising:

a chamber for receiving a fluid, at least a portion of the chamber comprising a first flexible portion being movable relative to a second portion of the chamber, the first flexible portion being adapted to change the volume of the chamber from a first volume to a second volume by bending of the first flexible portion; and at least a single force-generating actuator having an attachment point to the first flexible portion at a point of zero flexing displacement and an attachment point to the second portion of the chamber and generating forces in the direction of the first flexible portion's flexing displacement;

wherein the force-generating actuator exerts alternating forces between the flexible portion of the chamber and the second portion of the chamber with changes in the chamber volume resulting from the instantaneous sum of the actuator displacement and the flexing displacement of the first flexible portion.

2. The device of claim 1, wherein the actuator is driven at a frequency so as to store energy in the system resonance such that the displacements of the first flexible portion increase proportionately with the stored energy.

3. The fluid energy transfer device of claim 1, wherein the force-generating actuator comprises a variable reluctance actuator.

4. The fluid energy transfer device of claim 1, wherein the force-generating actuator comprises a solid electro-active actuator.

5. A pump, comprising:

the device of claim 1;

a fluid inlet port in fluid communication with the chamber; and a fluid outlet port in fluid communication with the chamber;

wherein the device is adapted to draw fluid into the chamber through the inlet port during movement of the flexible portion in a manner that increases the volume of the chamber, and wherein the device is adapted to expel fluid out of the chamber through the outlet port during movement of the flexible portion in a manner that decreases the volume of the chamber.

6. The fluid energy transfer device of claim 1, wherein:

the second portion of the chamber comprises a second flexible portion of the chamber movable relative to the first flexible portion of the chamber, and the force-generating actuator also having an attachment point to the second flexible portion at a point of zero flexing displacement of the second flexible portion, wherein the force-generating actuator exerts alternating forces between the first and second flexible portions of the chamber thereby resulting in peak displacements, between the maximum deflection points of the first and second flexible chamber portions, that are greater than the axial displacements of the force generating actuator.

7. An acoustic energy transfer device comprising: an acoustic resonator for supporting resonant acoustic modes, and the fluid energy transfer device of claim 1.

8. The acoustic energy transfer device of claim 7, wherein the acoustic modes are longitudinal modes.

9. The acoustic energy transfer device of claim 7, wherein the acoustic modes are radial modes.

10. The acoustic energy transfer device of claim 7, wherein the acoustic resonator comprises a resonant synthetic jet.

11. The acoustic energy transfer device of claim 7, wherein the acoustic resonator comprises the resonator of an acoustic compressor.

12. A synthetic jet device comprising: a synthetic jet, wherein the synthetic jet is driven by the fluid energy transfer device of claim 1.

* * * * *